US010391767B2

(12) United States Patent
Osaki et al.

(10) Patent No.: US 10,391,767 B2
(45) Date of Patent: Aug. 27, 2019

(54) LIQUID EJECTION HEAD

(71) Applicant: CANON KABUSHIKI KAISHA, Tokyo (JP)

(72) Inventors: Yasuhiko Osaki, Kamakura (JP); Toshiaki Hirosawa, Hiratsuka (JP); Genji Inada, Koshigaya (JP); Hiromasa Amma, Kawasaki (JP); Shogo Kawamura, Kawasaki (JP); Takuya Iwano, Inagi (JP); Shin Ishimatsu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/027,694

(22) Filed: Jul. 5, 2018

(65) Prior Publication Data

US 2019/0009535 A1 Jan. 10, 2019

(30) Foreign Application Priority Data

Jul. 7, 2017 (JP) ..... 2017-133996

(51) Int. Cl.
*B41J 2/14* (2006.01)

(52) U.S. Cl.
CPC ..... *B41J 2/14145* (2013.01); *B41J 2/14024* (2013.01); *B41J 2/14032* (2013.01); *B41J 2202/12* (2013.01); *B41J 2202/20* (2013.01)

(58) Field of Classification Search
CPC B41J 2/14145; B41J 2/14032; B41J 2202/20; B41J 2202/12; B41J 2/14024
USPC ..... 347/54, 56, 63, 65
See application file for complete search history.

(56) References Cited

U.S. PATENT DOCUMENTS

| | | | | |
|---|---|---|---|---|
| 7,416,629 | B2 | 8/2008 | Silverbrook et al. | |
| 7,469,987 | B2 | 12/2008 | Silverbrook et al. | |
| 7,571,541 | B2 | 8/2009 | Silverbrook et al. | |
| 7,736,458 | B2 | 6/2010 | Silverbrook et al. | |
| 7,776,175 | B2 | 8/2010 | Silverbrook et al. | |
| 7,997,697 | B2 * | 8/2011 | Arawaka | B41J 2/14314 347/44 |
| 8,087,168 | B2 | 1/2012 | Silverbrook et al. | |
| 8,308,273 | B2 | 11/2012 | Silverbrook et al. | |
| 9,925,792 | B2 * | 3/2018 | Aoki | B41J 2/14145 |
| 10,179,453 | B2 * | 1/2019 | Okushima | B41J 2/145 |
| 2006/0152557 | A1 | 7/2006 | Silverbrook et al. | |
| 2008/0266351 | A1 | 10/2008 | Silverbrook et al. | |

(Continued)

FOREIGN PATENT DOCUMENTS

JP 4495762 B2 7/2010

*Primary Examiner* — An H Do
(74) *Attorney, Agent, or Firm* — Venable LLP

(57) ABSTRACT

A page-wide type liquid ejection head includes a plurality of recording element substrates, each having an ejection port array including a plurality of ejection ports, each ejection port communicating with a pressure chamber including therein a recording element, and a liquid supply path for supplying a liquid to the pressure chamber. The liquid ejection head also includes a flow path member mounting the recording element substrates arranged thereon. The flow path member includes common supply flow paths and individual supply flow paths that connect the liquid supply path to the common supply flow paths, and the individual supply flow paths include portions running obliquely to the direction orthogonal to the longitudinal direction of the liquid ejection head.

19 Claims, 21 Drawing Sheets

(56) References Cited

U.S. PATENT DOCUMENTS

| | | | |
|---|---|---|---|
| 2009/0102882 | A1 | 4/2009 | Silverbrook et al. |
| 2018/0361748 | A1 | 12/2018 | Inada et al. |
| 2019/0001691 | A1 | 1/2019 | Inada et al. |

* cited by examiner

LIQUID EJECTION HEAD

BACKGROUND OF THE INVENTION

Field of the Invention

The present disclosure relates to a liquid ejection head.

Description of the Related Art

A liquid ejection head that ejects a liquid such as ink in response to a drive signal for image recording or the like includes an energy generating element that generates energy for liquid ejection. For example, there is a liquid ejection head (inkjet recording head) that applies a voltage pulse in accordance with recorded data, to each of a plurality of energy generating elements (heating resistors as an example), and ejects liquid ink by using thermal energy which is generated. Liquid ejection heads like this are capable of high-resolution and high-speed image formation, and therefore are widely used. In particular, a liquid ejection apparatus including a full-line type (page-wide type) liquid ejection head having a length corresponding to a width of a recording medium, with a plurality of energy generating elements arranged with high density throughout a substantially entire length thereof is capable of higher speed recording, and has become widespread rapidly in recent years. Many long liquid ejection heads like this are each constructed by a plurality of chips (recording element substrates) being arranged along a width direction of a recording medium with a manufacturing yield taken into consideration, and the respective chips are small. On a support member on which a plurality of chips are mounted, a plurality of liquid supply holes (communication ports) for supplying liquids to the respective chips need to be formed at very narrow intervals with high precision along an arrangement direction of the chips. Therefore, a plurality of flow paths for supplying liquids to the plurality of liquid supply holes from liquid retaining members such as a liquid tank are constructed to transition from parts where the plurality of flow paths are disposed at relatively large intervals to parts where the plurality of flow paths are disposed at relatively small intervals. Japanese Patent No. 4495762 discloses a full-line type liquid ejection head in which widths and intervals of flow paths become narrower stepwise from a support member to respective chips.

The flow paths which supply liquids to the respective chips in Japanese Patent No. 4495762 are formed substantially perpendicularly to the arrangement direction of the chips, and a shortest distance between the adjacent flow paths is determined by a position in the arrangement direction of the chips. In the structure in which liquids of different kinds (for example, different colors) are supplied to the respective chips, joint portions of the chips, substrates and the like need to be sealed at each flow path so that different kinds of liquids do not mix with one another. However, in the structure in which a large number of flow paths are formed in a narrow region as in Japanese Patent No. 4495762, seal regions among the flow paths are so narrow that sealing with high reliability for each of the flow paths is difficult.

SUMMARY OF THE INVENTION

An object of the present disclosure is to provide a page-wide type liquid ejection head that has high reliability of seal between adjacent flow paths and can perform high-quality liquid ejection even when the number of flow paths that supply liquids to recording element substrates is large.

A liquid ejection head of the present disclosure is a page-wide type liquid ejection head, including: a plurality of recording element substrates each having an ejection port array including a plurality of ejection ports for ejecting a liquid, each ejection port communicating with a pressure chamber including therein a recording element that generates energy for ejecting a liquid, and a liquid supply path that supplies a liquid to the pressure chamber, and a flow path member on which the plurality of recording element substrates are arranged, wherein the flow path member includes a plurality of common supply flow paths that are provided adjacently to each other as running along a longitudinal direction of the liquid ejection head for supplying a liquid to the plurality of recording element substrates, and a plurality of individual supply flow paths that connect the liquid supply path of each recording element substrate to the common supply flow paths, and the plurality of individual supply flow paths include portions running obliquely to a direction orthogonal to the longitudinal direction of the liquid ejection head, as viewed from an ejection port array surface.

Further features of the present invention will become apparent from the following description of exemplary embodiments with reference to the attached drawings.

DESCRIPTION OF THE EMBODIMENTS

Hereinafter, embodiments of the present disclosure will be described with use of the drawings. However, the following description does not limit the range of the present disclosure. As an example, a thermal type that ejects a liquid by generating air bubbles by heating elements is adopted in the following embodiments, but the present disclosure can be also applied to liquid ejection heads in which a piezo type and various other liquid ejection types are adopted.

Note that the liquid ejection head of the present disclosure that ejects liquids such as ink is applicable to apparatuses such as a printer, a copying machine, a facsimile machine having a communication system, and a word processor having a printer unit, and further to industrial recording apparatuses that are multifunctionally combined with various processing apparatuses. For example, the liquid ejection head can also be used for applications such as biochip production, electronic circuit printing, semiconductor substrate production, and 3D printers.

The liquid ejection apparatuses of the following embodiments are inkjet recording apparatuses (recording apparatuses) each in a mode of circulating a liquid such as ink between a tank and the liquid ejection head, but may be in other modes. For example, the liquid ejection apparatuses may be each in a mode of providing two tanks at an upstream side and a downstream side of the liquid ejection head, and causing ink in pressure chambers to flow by passing the ink from one of the tanks to the other tank.

First Embodiment (Explanation of Inkjet Recording Apparatus)

Figure 1:
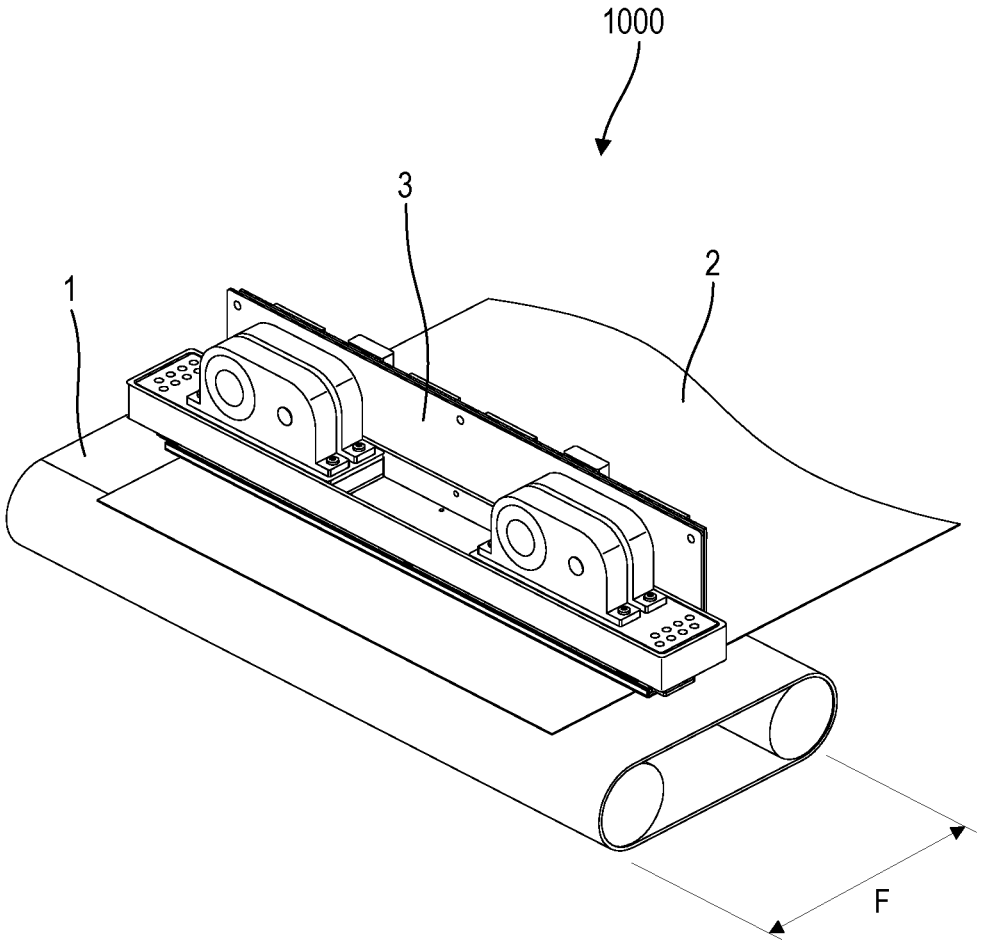
FIG. 1 is a perspective view illustrating a schematic construction of a liquid ejection apparatus of a first embodiment of the present disclosure.

FIG. 1 illustrates a schematic construction of the liquid ejection apparatus, in particular, an inkjet recording apparatus 1000 (hereinafter, also referred to as a recording apparatus) that ejects ink and performs recording. The recording apparatus 1000 includes a conveying section 1 that conveys a recording medium 2, and a line type (page-wide type) liquid ejection head 3 that is disposed substantially orthogonally to a conveying direction of the recording medium. The recording apparatus 1000 is a line type recording apparatus that performs continuous recording by one-pass while continuously or intermittently conveying a plurality of recording media 2. The recording medium 2 is not limited to a cut sheet, but may be a continuous roll sheet. Further, the present disclosure is also applicable to an intermediate transfer type apparatus that does not directly perform ejection to a medium such as a sheet from the liquid ejection head 3, but ejects a liquid to an intermediate transfer member first to form an image on the transfer member, and thereafter transfers the image onto the medium such as a sheet. The liquid ejection head 3 is capable of full-color printing by CMYK (cyan, magenta, yellow and black) inks, and a liquid supply unit that is a supply path supplying a liquid to the liquid ejection head as described later, a main tank, and a buffer tank (FIG. 2) are fluidly connected to the liquid ejection head 3. Further, an electric control unit that transmits electric power and an ejection control signal to the liquid ejection head 3 is electrically connected to the liquid ejection head 3. A liquid route and an electric signal route in the liquid ejection head 3 will be described later.

(Explanation of First Circulation Route)

Figure 2:
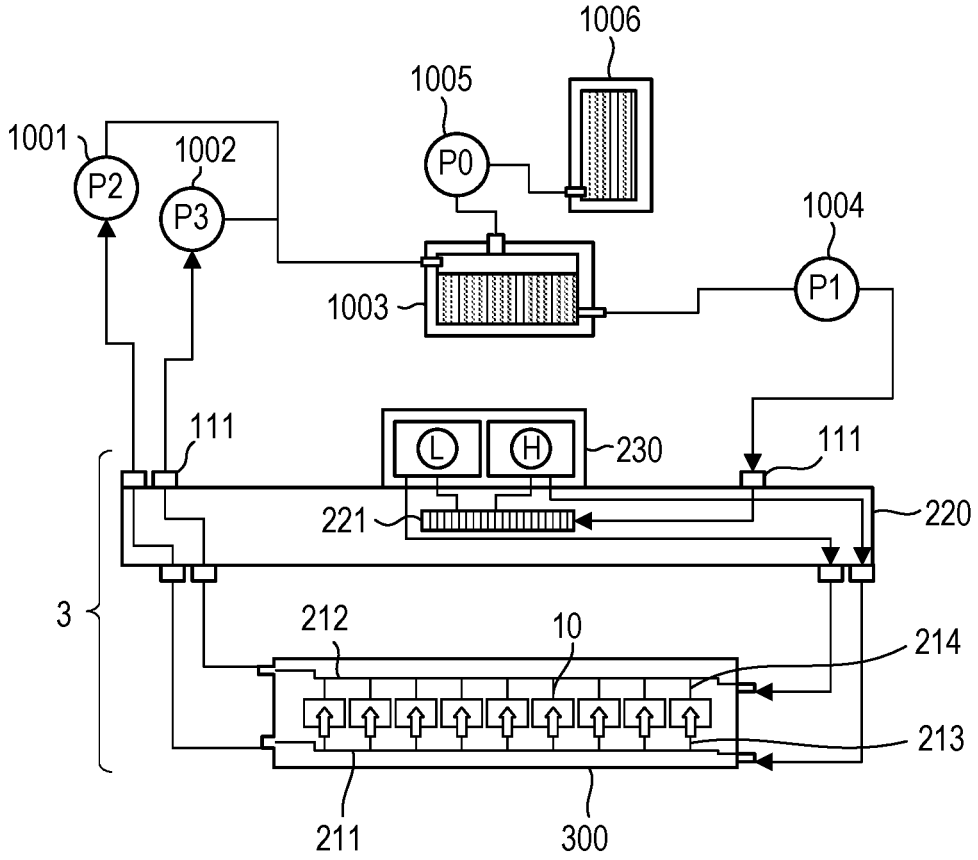
FIG. 2 is a view illustrating a circulation flow path of the liquid ejection apparatus illustrated in FIG. 1.

FIG. 2 is a schematic view illustrating a first circulation route that is one mode of a circulation route which is applied to the recording apparatus of the present embodiment. A state where the liquid ejection head 3 is fluidly connected to a first circulation pump (high pressure side) 1001, a first circulation pump (low pressure side) 1002, a buffer tank 1003 and the like is illustrated. Note that FIG. 2 illustrates only a route in which an ink of one color of CMYK inks flows to simplify explanation, but in reality, circulation routes for four colors are provided in the liquid ejection head 3 and the recording apparatus main unit. The buffer tank 1003 as a sub tank which is connected to a main tank 1006 has an air communication hole (not illustrated) that allows an inside and an outside of the tank to communicate with each other, and is capable of discharging air bubbles in the ink to the outside. The buffer tank 1003 is also connected to a replenishing pump 1005. The replenishing pump 1005 transfers a consumed amount of ink to the buffer tank 1003 from the main tank 1006 when the liquid is consumed in the liquid ejection head 3 by ejecting (discharging) the ink from the ejection ports of the liquid ejection head such as recording, and suction recovery by ink ejection.

The two circulation pumps 1001 and 1002 have a role of sucking a liquid from the liquid connection section 111 of the liquid ejection head 3 to cause the liquid to flow to the buffer tank 1003. As the first circulation pump, a positive displacement pump having a quantative liquid delivering ability is preferable. Specifically, a tube pump, a gear pump, a diaphragm pump, a syringe pump and the like are cited, and a mode of ensuring a fixed flow rate by arranging an ordinary fixed low rate valve or a relief valve in a pump outlet, for example, may be adopted. A certain fixed amount of ink flows inside of each of a common supply flow path 211 and a common collection flow path 212 by the first circulation pump (high pressure side) 1001 and the first circulation pump (low pressure side) 1002 at a time of drive of the liquid ejection head 3. The flow rate is preferably set at such a rate that temperature difference among respective recording element substrates 10 in the liquid ejection head 3 does not affect recorded image quality. In fact, when an excessively large flow rate is set, a negative pressure difference becomes so large in the respective recording element substrates 10 that image density unevenness occurs, due to the influence of the pressure loss in the flow paths in the liquid ejection unit 300. Consequently, it is preferable to set the flow rate with a temperature difference and a negative pressure difference among the respective recording element substrates 10 taken into consideration.

A negative pressure control unit 230 is provided in a route between a second circulation pump 1004 and the liquid ejection unit 300. This has a function of operating to keep a pressure at a downstream side (that is, a liquid ejection unit 300 side) from the negative pressure control unit 230 at a fixed pressure that is set in advance even when a flow rate of a circulation system varies due to a difference in duty (Duty) for performing recording. As two pressure adjusting mechanisms that construct the negative pressure control unit 230, any mechanism that can control pressures downstream of the pressure adjusting mechanisms themselves to a variation in a fixed range or less with a desired set pressure as a center may be used. As an example, a mechanism similar to a so-called "pressure reducing regulator" can be used. When the pressure reducing regulator is used, it is preferable to pressurize an upstream side of the negative pressure control unit 230 via the liquid supply unit 220 by the second circulation pump 1004 as illustrated in FIG. 2. In this way, an influence of a water head on the liquid ejection head 3, of the buffer tank 1003 can be suppressed, so that a degree of freedom of layout of the buffer tank 1003 in the recording apparatus 1000 can be increased. The second circulation pump 1004 may be any pump that has a lift pressure of a fixed pressure or more in a range of an ink circulation flow rate that is used at a time of drive of the liquid ejection head 3, and a turbo type pump, a positive displacement pump and the like can be used. Specifically, a diaphragm pump or the like is adoptable. Further, instead of the second circulation pump 1004, for example, a water head tank that is disposed with a certain fixed water head difference with respect to the negative pressure control unit 230 is adoptable.

As illustrated in FIG. 2, the negative pressure control unit 230 includes two pressure adjusting mechanisms to which different control pressures from each other are set respectively. Of the two negative pressure adjusting mechanisms, a relative high pressure set side (described as H in FIG. 2), and a relative low pressure set side (described as L in FIG. 2) are respectively connected to the common supply flow path 211 and the common collection flow path 212 in the liquid ejection unit 300 via an inside of the liquid supply unit 220. In the liquid ejection unit 300, an individual supply flow path 213 and an individual collection flow path 214 that communicate with the common supply flow path 211, the common collection flow path 212 and the respective recording element substrates are provided. The individual flow paths 213 and 214 communicate with the common supply flow path 211 and the common collection flow path 212, so that flows (arrows in FIG. 2) in which a part of liquid passes through internal flow paths of the recording element substrates 10 from the common supply flow path 211 to reach the common collection flow path 212 are generated. This is because the pressure adjusting mechanism H is connected to the common supply flow path 211, and the pressure adjusting mechanism L is connected to the common collection flow path 212 respectively, and therefore a differential pressure occurs between the two common flow paths. A plurality of common supply flow paths 211 are provided adjacently to each other along a longitudinal direction of the liquid ejection head.

In this way, in the liquid ejection unit 300, the flows in which a part of the liquid passes through the insides of the respective recording element substrates 10 are generated while the liquid is allowed to flow to pass through the insides of the common supply flow path 211 and the common collection flow path 212 respectively. Consequently, heat that is generated in the respective recording element substrates 10 can be discharged outside of the recording element substrates 10 by flows of the common supply flow path 211 and the common collection flow path 212. Further, by the construction like this, when recording by the liquid ejection head 3 is performed, flows of ink can also be generated in ejection ports and pressure chambers that do not perform ejection, so that increase in viscosity of the ink in those sites can be suppressed. Further, the ink increased in viscosity and foreign matters in the ink can be discharged to the common collection flow path 212. Consequently, the liquid ejection head 3 of the present embodiment is capable of recording at a high speed with high image quality.

(Explanation of Liquid Ejection Head Structure)

Figure 3A:
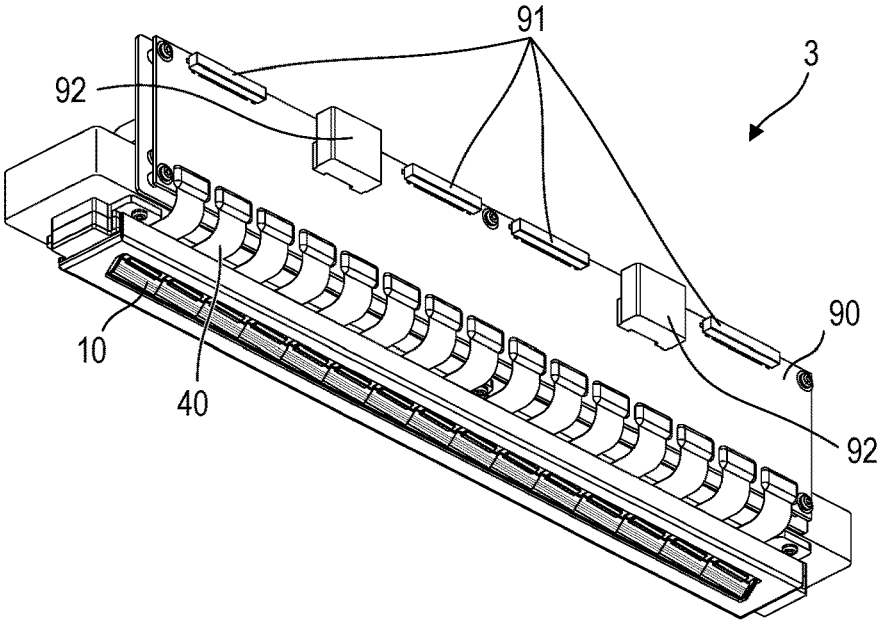
FIGS. 3A and 3B are perspective views of a liquid ejection head of the first embodiment of the present disclosure.
Figure 3B:
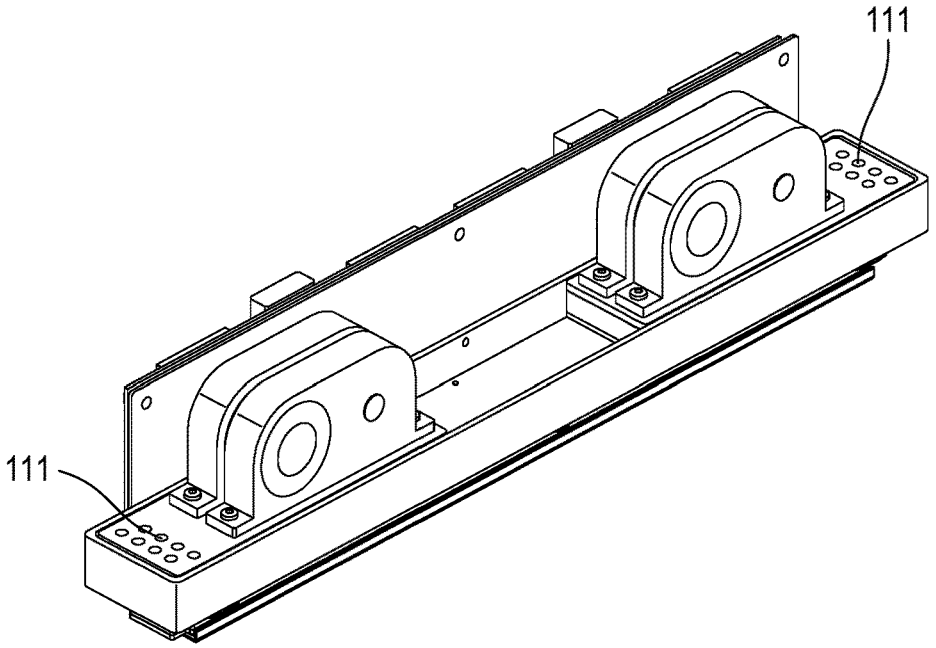

A structure of the liquid ejection head 3 according to the first embodiment will be described. FIGS. 3A and 3B are perspective views of the liquid ejection head 3 according to the present embodiment. The liquid ejection head 3 is a line type liquid ejection head in which 15 of the recording element substrates 10 each capable of ejecting inks of four colors of CMYK are arranged rectilinearly (disposed in line). As illustrated in FIG. 3A, the liquid ejection head 3 includes signal input terminals 91 and electric power supply terminals 92 that are electrically connected to the respective recording element substrates 10 via flexible wiring boards 40 and an electric wiring board 90. The signal input terminals 91 and the electric power supply terminals 92 are electrically connected to a control section of the recording apparatus 1000, and respectively supply ejection drive signals and electric power necessary for ejection to the recording element substrates 10. By concentrating wiring by electric circuits in the electric wiring board 90, numbers of signal input terminals 91 and electric power supply terminals 92 can be decreased as compared with the number of recording element substrates 10. Thereby, the number of electric connection portions that need to be detached can be small when the liquid ejection head 3 is assembled to the recording apparatus 1000, or at a time of replacement of the liquid ejection head. As illustrated in FIG. 3B, liquid connection sections 111 that are provided at both end portions of the liquid ejection head 3 are connected to a liquid supply system of the recording apparatus 1000. Thereby, inks of four colors of CMYK are supplied to the liquid ejection head 3 from the supply system of the recording apparatus 1000, and the inks passing through the inside of the liquid ejection head 3 are collected into the supply system of the recording apparatus 1000. In this way, the inks of the respective colors are capable of circulating via a route of the recording apparatus 1000 and a route of the liquid ejection head 3.

Figure 4:
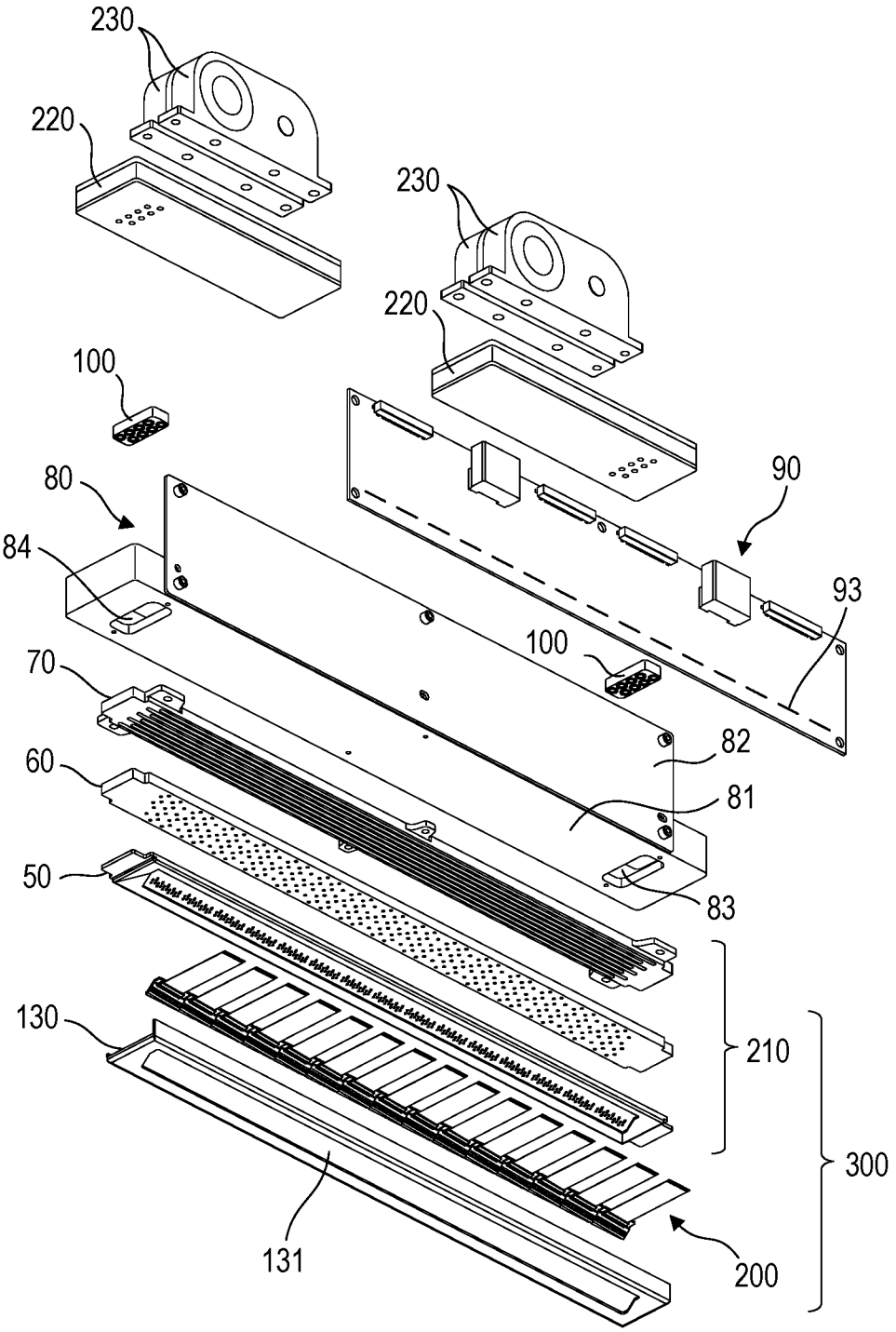
FIG. 4 is an exploded perspective view of the liquid ejection head illustrated in FIGS. 3A and 3B.

FIG. 4 illustrates an exploded perspective view of respective components or units constructing the liquid ejection head 3. The liquid ejection unit 300, the liquid supply unit 220 and the electric wiring board 90 are attached to an enclosure 80. The liquid connection sections 111 (FIG. 2) are provided in the liquid supply unit 220, and a filter 221 (FIG. 2) for each color that communicates with each opening of the liquid connection section 111 is provided inside the liquid supply unit 220, to remove foreign matters in the ink which is supplied. The filters 221 for two colors are provided in each of the two liquid supply filters. The liquids that pass through the filter 221 are supplied to the negative pressure control unit 230 that is disposed on the liquid supply unit 220 correspondingly to the respective colors. The negative pressure control unit 230 is a unit including a pressure adjusting valve for each color, and generates the following operation by operations of a valve, a spring member and the like provided inside of each of the units. A change in pressure loss in the supply system (a supply system at an upstream side of the liquid ejection head 3) of the recording apparatus 1000, which occurs with a variation in the flow rate of the liquid is greatly attenuated, and a negative pressure change at a downstream side (a liquid ejection unit 300 side) from the negative pressure control unit can be stabilized to be within a certain fixed range. In the negative pressure control unit 230 of the respective colors, the two pressure adjusting valves are contained for each color as illustrated in FIG. 2. The two pressure adjusting valves are respectively set to different control pressures, a high pressure side communicates with the common supply flow path 211 in the liquid ejection unit 300, whereas a low pressure side communicates with the common collection flow path 212 respectively via the liquid supply unit 220.

The enclosure 80 is constructed by a liquid ejection unit supporting section 81 and an electric wiring board supporting section 82, supports the liquid ejection unit 300 and the electric wiring board 90, and ensures rigidity of the liquid ejection head 3. The electric wiring board supporting section 82 is for supporting the electric wiring board 90, and is fixed to the liquid ejection unit supporting section 81 by screwing. The liquid ejection unit supporting section 81 has a role of correcting a warp and deformation of the liquid ejection unit 300, and ensuring relative positional precision of the plurality of recording element substrates 10, and thereby suppresses streaks and unevenness in a recorded object. Consequently, the liquid ejection unit supporting section 81 preferably has sufficient rigidity, and as a material, a metal material such as a stainless steel (SUS) and an aluminum, or ceramics such as an alumina is preferable. In the liquid ejection unit supporting section 81, openings 83 and 84 to which joint rubbers 100 are inserted are provided. The liquid supplied from the liquid supply unit 220 is guided to a third flow path member 70 constructing the liquid ejection unit 300 via the joint rubbers.

The liquid ejection unit 300 includes a plurality of ejection modules 200 and the flow path member 210, and a cover member 130 is attached to a surface on a recording medium side of the liquid ejection unit 300. Here, the cover member 130 is a member having a frame-shaped surface provided with an elongate opening 131 as illustrated in FIG. 4, and from the opening 131, the recording element substrates 10 and sealing members 110 (FIGS. 8A and 8B) included in the ejection modules 200 are exposed. A frame portion around the opening 131 has a function as an abutting surface of a capping member that caps the liquid ejection head 3 at a recording standby time. Consequently, a closed space is preferably formed at a time of capping by applying an adhesive, a sealing material, a filler or the like along a perimeter of the opening 131, and burying recesses and protrusions and gaps on the ejection port surfaces of the liquid ejection unit 300.

Next, a structure of the flow path member 210 included in the liquid ejection unit 300 will be described. As illustrated in FIG. 4, the flow path member 210 is what is formed by stacking a first flow path member 50, a second flow path member 60 and a third flow path member 70. The flow path member 210 is a flow path member for distributing the liquid supplied from the liquid supply unit 220 to the respective ejection modules 200, and returning the liquid which returns from the ejection modules 200 to the liquid supply unit 220. The flow path member 210 is fixed to the liquid ejection unit supporting section 81 by screwing, and thereby a warp and deformation of the flow path member 210 are suppressed.

Figure 5A:
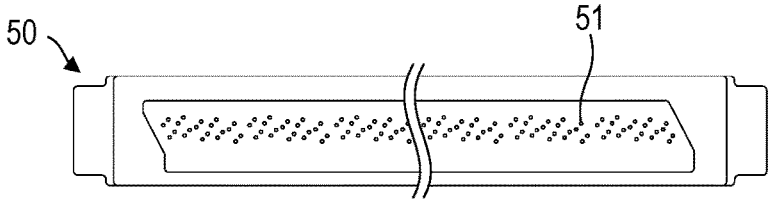
FIGS. 5A, 5B, 5C, 5D, 5E and 5F are plan views and bottom views of respective flow path members of the liquid ejection head illustrated in FIGS. 3A and 3B.
Figure 5B:
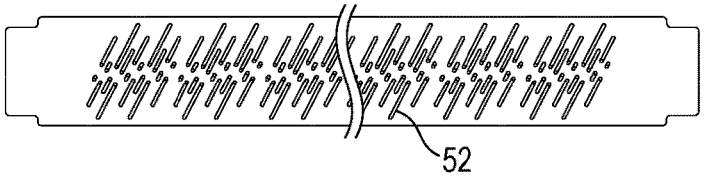
Figure 5C:
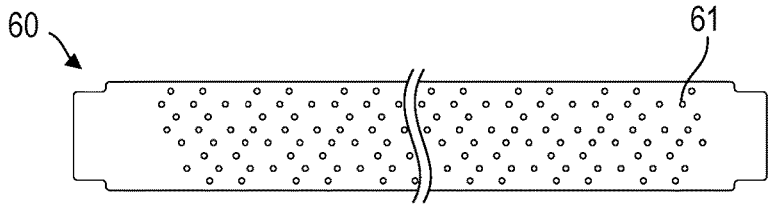
Figure 5D:
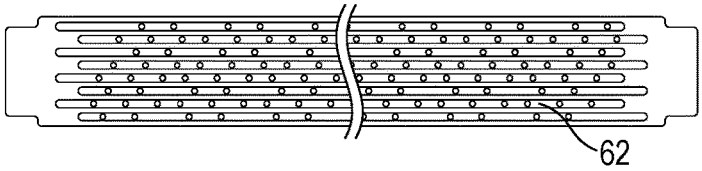
Figure 5E:
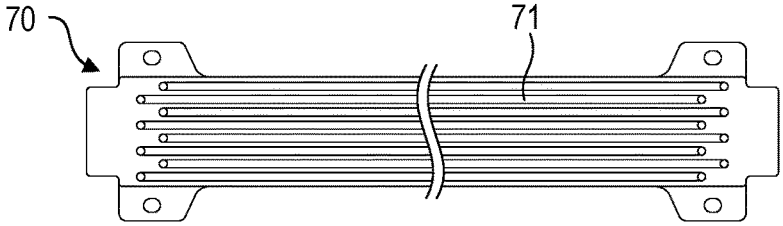
Figure 5F:
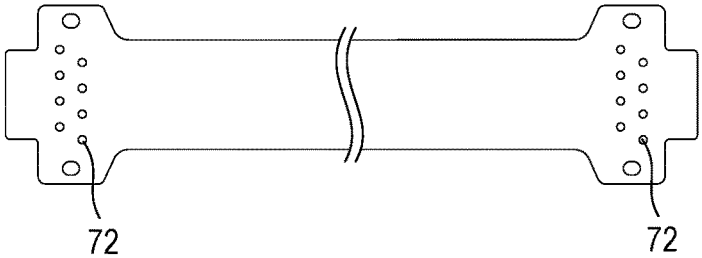
Figure 6:
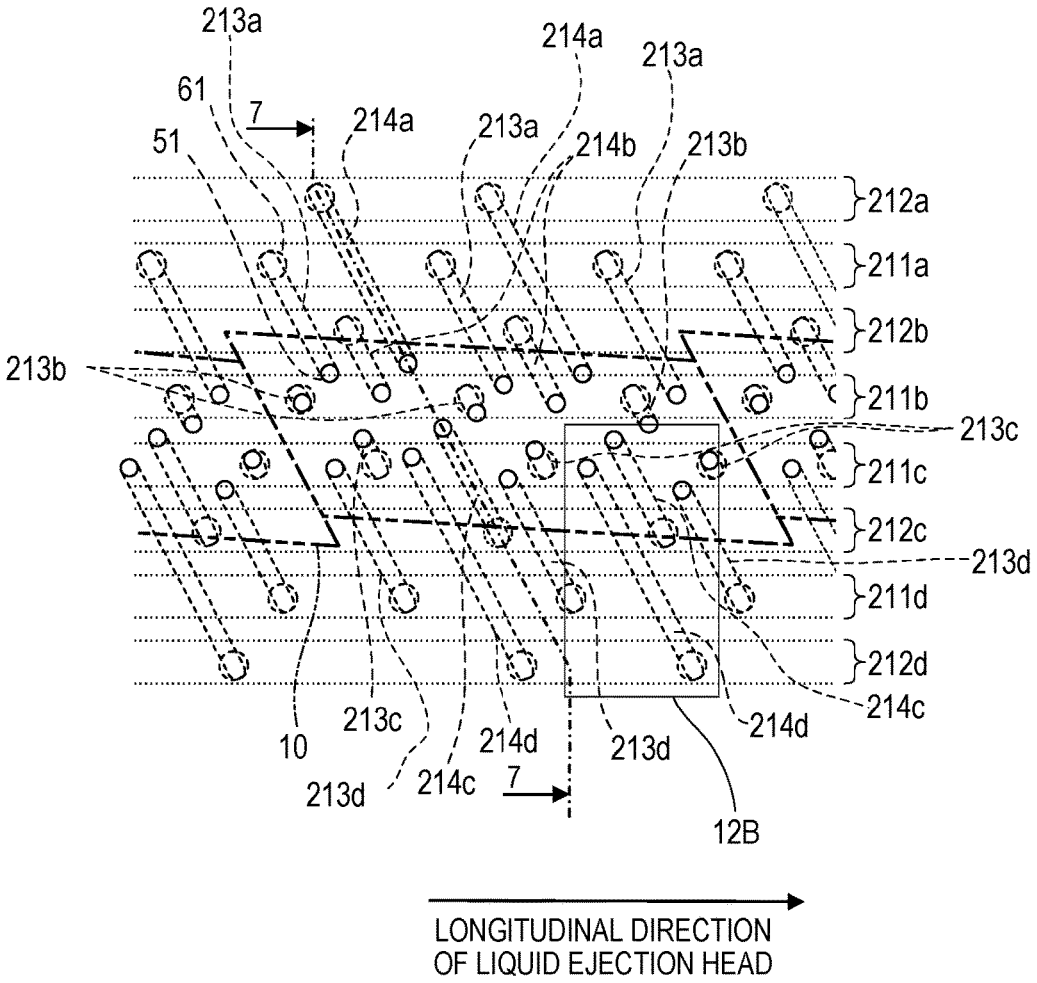
FIG. 6 is a transparent view of flow path members illustrated in FIGS. 5A to 5F.

FIGS. 5A to 5F are views that illustrates front surfaces and back surfaces of the respective flow path members of the first to third flow path members. FIG. 5A illustrates a surface on a side where the ejection module 200 is mounted, of the first flow path member 50, and FIG. 5F illustrates a surface on a side abutting on the liquid ejection unit supporting section 81, of the third flow path member 70. The first flow path member 50 and the second flow path member 60 are joined so that FIG. 5B and FIG. 5C that are abutment surfaces of the respective flow path members face each other, and the second flow path member and the third flow path member are joined so that FIG. 5D and FIG. 5E that are abutment surfaces of the respective flow path members face each other. By joining the second flow path member 60 and the third flow path member 70, eight common flow paths running in a longitudinal direction of the flow path members are formed by common flow channels 62 and 71 that are formed in the respective flow path members. Thereby, a set of the common supply flow path 211 and the common collection flow path 212 is formed for each color in the flow path member 210 (FIG. 6). Communication ports 72 of the third flow path member 70 communicate with the respective holes of the joint rubber 100, and fluidly communicate with the liquid supply unit 220. A plurality of communication ports 61 are formed on a bottom surface of the common flow channel 62 of the second flow path member 60, and communicate with one end portion of the individual flow channels 52 of the first flow path member 50. Communication ports 51 are formed on the other end portions of the individual flow channels 52 of the first flow path member 50, and fluidly communicate with a plurality of ejection modules 200 via the communication ports 51. The individual flow channels 52 enable flow paths to concentrate on a center side of the flow path member. The individual flow paths 213 and 214 are formed by grooves 52 that are formed on a surface on a recording element substrate side, of the flow path member 50 that is a plate member, and holes (the communication ports 51) that communicate with the grooves 52 and open to a surface at an opposite side from the recording element substrate side, of the flow path member 50.

The first to third flow path members preferably have corrosion resistance to a liquid, and are formed from a material with a low linear expansion coefficient. As the material, for example, a composite material (a resin material) formed by using an alumina, LCP (liquid crystal polymer), PPS (polyphenyl sulfide) or PSF (polysulfone) as a base material and adding an inorganic filler such as silica fine particles or fibers can be preferably used. As a forming method of the flow path member 210, the three flow path members may be stacked and joined to one another, or may be joined by welding when the resin composite material is selected as the material.

Next, with use of FIG. 6, a connection relation of the respective flow paths in the flow path member 210 will be described. FIG. 6 is a transparent view of partially enlarged flow paths in the flow path member 210 which is formed by joining the first to third flow path members, as seen from a side of the surface on which the ejection modules 200 are mounted, of the first flow path member 50. In the flow path member 210, the common supply flow paths 211 (211*a*, 211*b*, 211*c* and 211*d*) and the common collection flow paths 212 (212*a*, 212*b*, 212*c* and 212*d*) which run in the longitudinal direction of the liquid ejection head 3 are provided for the respective colors. A plurality of individual supply flow paths 213 (213*a*, 213*b*, 213*c* and 213*d*) which are formed by the individual flow channels 52 are connected to the common supply flow paths 211 of the respective colors via the communication ports 61. Further, a plurality of individual collection flow paths 214 (214*a*, 214*b*, 214*c* and 214*d*) which are formed by the individual flow channels 52 are connected to the common collection flow paths 212 of the respective colors via the communication ports 61. By a flow path structure like this, the ink can be concentrated onto the recording element substrates 10 which are located in a central part of the flow path member from the respective common supply flow paths 211 via the individual supply flow paths 213. Further, the ink can be collected into the respective common collection flow paths 212 from the recording element substrates 10 via the individual collection flow paths 214.

Figure 7:
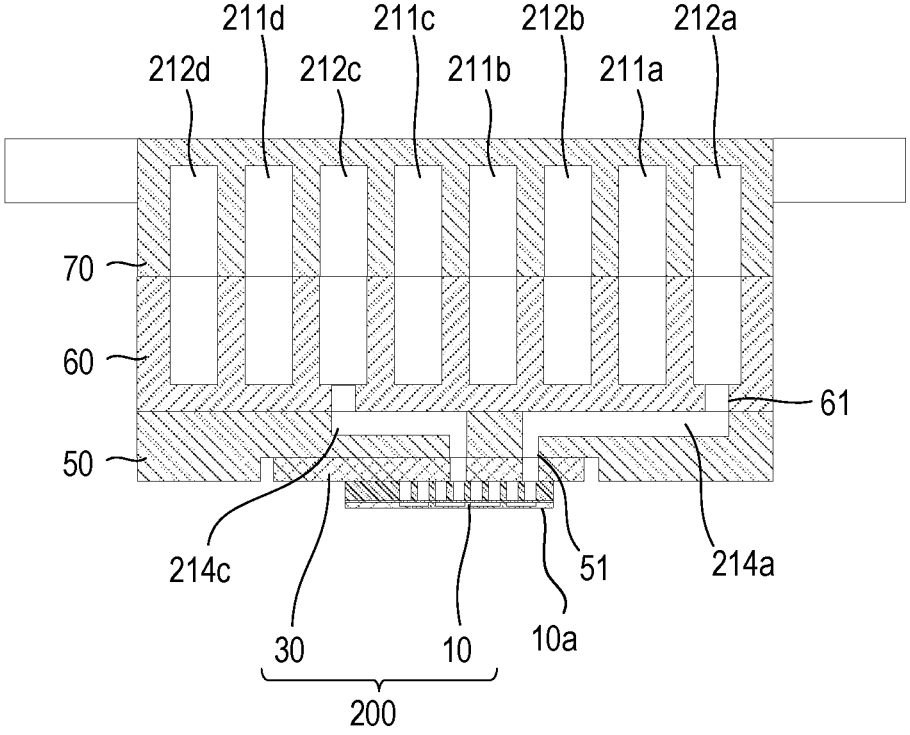
FIG. 7 is a sectional view of the liquid ejection head illustrated in FIGS. 3A and 3B.

FIG. 7 is a view illustrating a section in line 7-7 in FIG. 6. As illustrated in FIG. 7, the respective individual collection flow paths (214*a*, 214*c*) communicate with the ejection module 200 via the communication ports 51. FIG. 7 illustrates only the individual collection flow paths (214*a*, 214*c*), but in other sections, the individual supply flow paths 213 and the ejection modules 200 communicate with each other as illustrated in FIG. 6. In a support member 30 and the recording element substrate 10 included in each of the ejection modules 200, a flow path for supplying the ink from the first flow path member 50 to recording elements 15 (FIG. 9B) provided in the recording element substrate 10 is formed. Further, a flow path for collecting (returning) a part or all of the liquid which is supplied to the recording elements 15 and transfer the collected liquid to the first flow path member 50 is also formed. Here, the common supply flow paths 211 of the respective colors are connected to the negative pressure control units 230 (the high pressure side) of the corresponding colors via the liquid supply units 220, and the common collection flow paths 212 are connected to the negative pressure control unit 230 (the low pressure side) via the liquid supply units 220. By the negative pressure control unit 230, a differential pressure (a pressure difference) is generated between the common supply flow path 211 and the common collection flow path 212. Consequently, in the liquid ejection head of the present embodiment in which the respective flow paths are connected as illustrated in FIGS. 6 and 7, a flow flowing sequentially to the common supply flow path 211, the individual supply flow path 213, the recording element substrate 10, the individual collection flow path 214 and the common collection flow path 212 is generated in each of the colors.

(Explanation of Ejection Module)

Figure 8A:
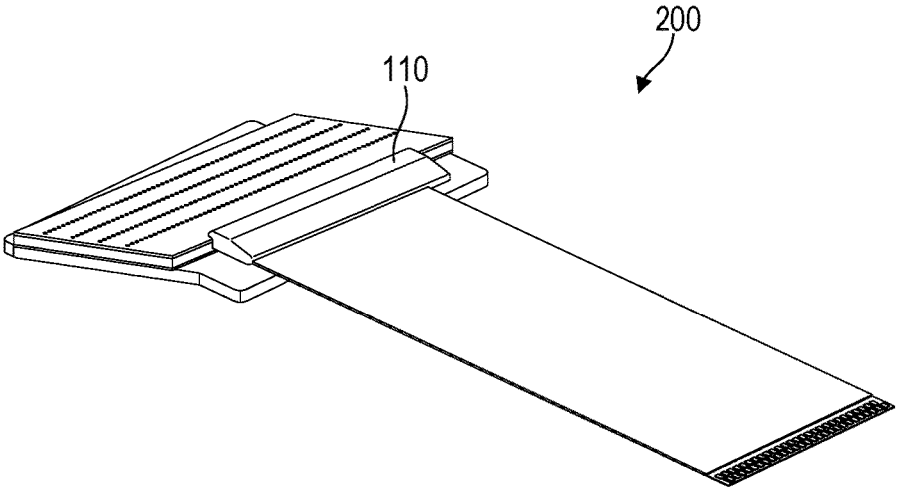
FIGS. 8A and 8B are a perspective view and an exploded perspective view of an ejection module of the liquid ejection head illustrated in FIGS. 3A and 3B.
Figure 8B:
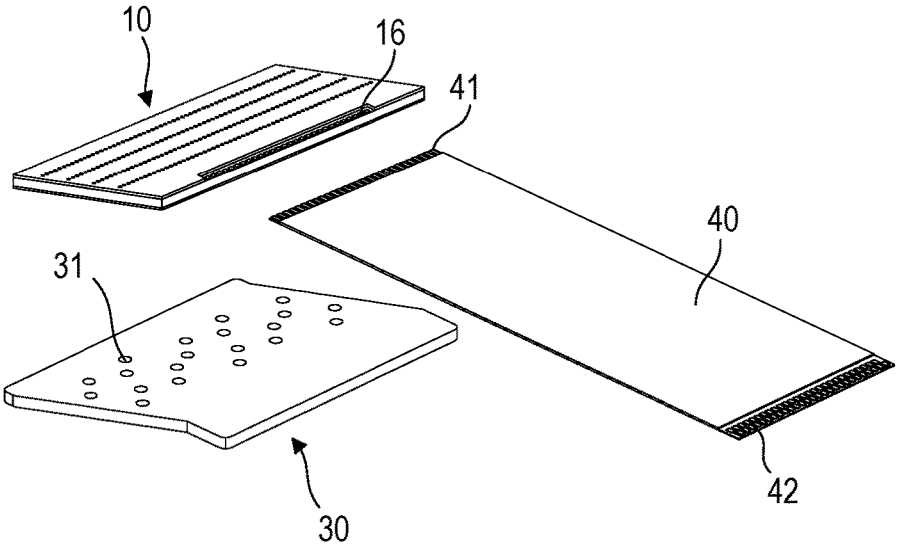

FIG. 8A illustrates a perspective view of one ejection module 200, and FIG. 8B illustrates an exploded view thereof. As a production method of the ejection module 200, the recording element substrate 10 and the flexible wiring board 40 are firstly joined onto the support member 30 which is provided with liquid communication ports 31 in advance. Thereafter, a terminal 16 on the recording element substrate 10 and a terminal 41 on the flexible wiring board 40 are electrically connected by wire bonding, and thereafter, the wire bonding section (an electrically connecting section) is sealed by being covered with a sealer 110. A terminal 42 at an opposite side from the recording element substrate 10, of the flexible wiring board 40 is electrically connected to a connection terminal 93 (refer to FIG. 4) of the electric wiring board 90. The support member 30 is a supporter that supports the recording element substrate 10, and is also a flow path member that causes the recording element substrate 10 and the flow path member 210 to communicate with each other fluidly. The flow paths of the support member connect the liquid supply path 18 and the individual supply flow path 213, and connect the liquid collection path 19 and the individual collection flow path 214. The support member 30 preferably has a high flatness and can be joined to the recording element substrate with sufficiently high reliability. As the material, for example, an alumina, and a resin material are preferable.

(Explanation of Structure of Recording Element Substrate)

Figure 9A:
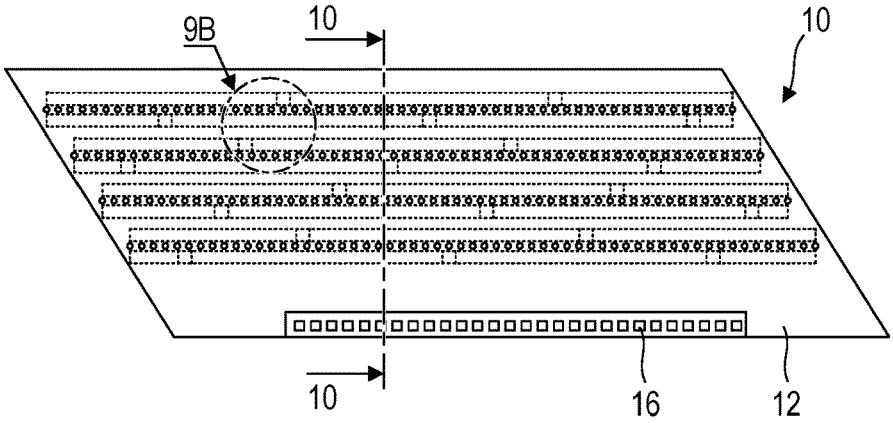
FIGS. 9A, 9B and 9C are a plan view, an enlarged plan view and a rear view of a recording element substrate of the liquid ejection head illustrated in FIGS. 3A and 3B.
Figure 9B:
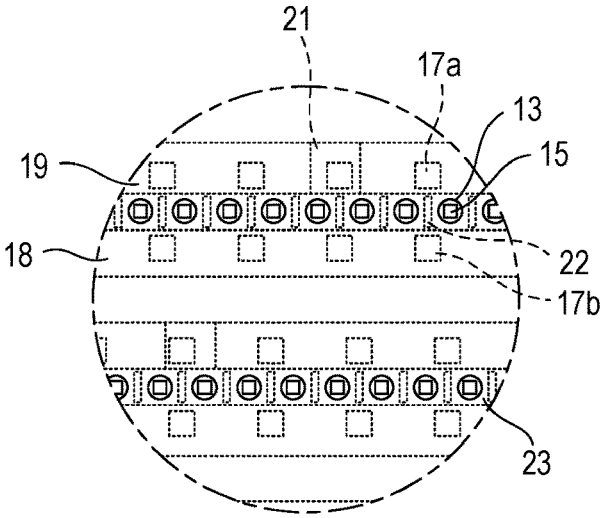
Figure 9C:
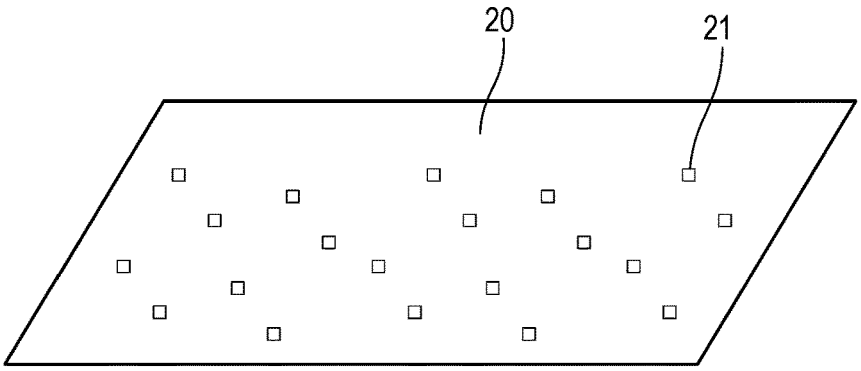

A structure of the recording element substrate 10 in the present embodiment will be described. FIG. 9A illustrates a plan view of a surface on a side where the ejection ports 13 are formed, of the recording element substrate 10 of the liquid ejection head, FIG. 9B illustrates an enlarged view of a part shown by 9B in FIG. 9A, and FIG. 9C illustrates a bottom view of FIG. 9A. As illustrated in FIG. 9A, ejection port arrays in four rows corresponding to the respective ink colors are formed in an ejection port formation member 12 of the recording element substrate 10. Note that hereinafter, a direction in which the ejection port array where a plurality of ejection ports 13 are arranged extends will be referred to as an "ejection port array direction".

As illustrated in FIG. 9B, in positions corresponding to the respective ejection ports 13, the recording elements 15 which are heating elements for foaming the liquid by thermal energy are disposed. Pressure chambers 23 including the recording elements 15 therein are demarcated by partition walls 22. The recording element 15 is electrically connected to a terminal 16 in FIG. 9A by electric wiring (not illustrated) provided in the recording element substrate 10. The recording element boils the liquid by generating heat based on a pulse signal that is input via the electric wiring board 90 (FIG. 4) and the flexible wiring board 40 (FIG. 8B) from the control circuit of the recording apparatus 1000. The liquid is ejected from the ejection port 13 with a force of foaming by boiling. As illustrated in FIG. 9B, along each of the ejection port arrays, the liquid supply path 18 runs on one side, and the liquid collection path 19 runs on the other side respectively. The liquid supply path 18 and the liquid collection path 19 are flow paths provided in the recording element substrate 10 and running in the ejection port array direction, and communicate with the ejection ports 13 via supply ports 17*a* and collection ports 17*b* respectively.

Figure 10:
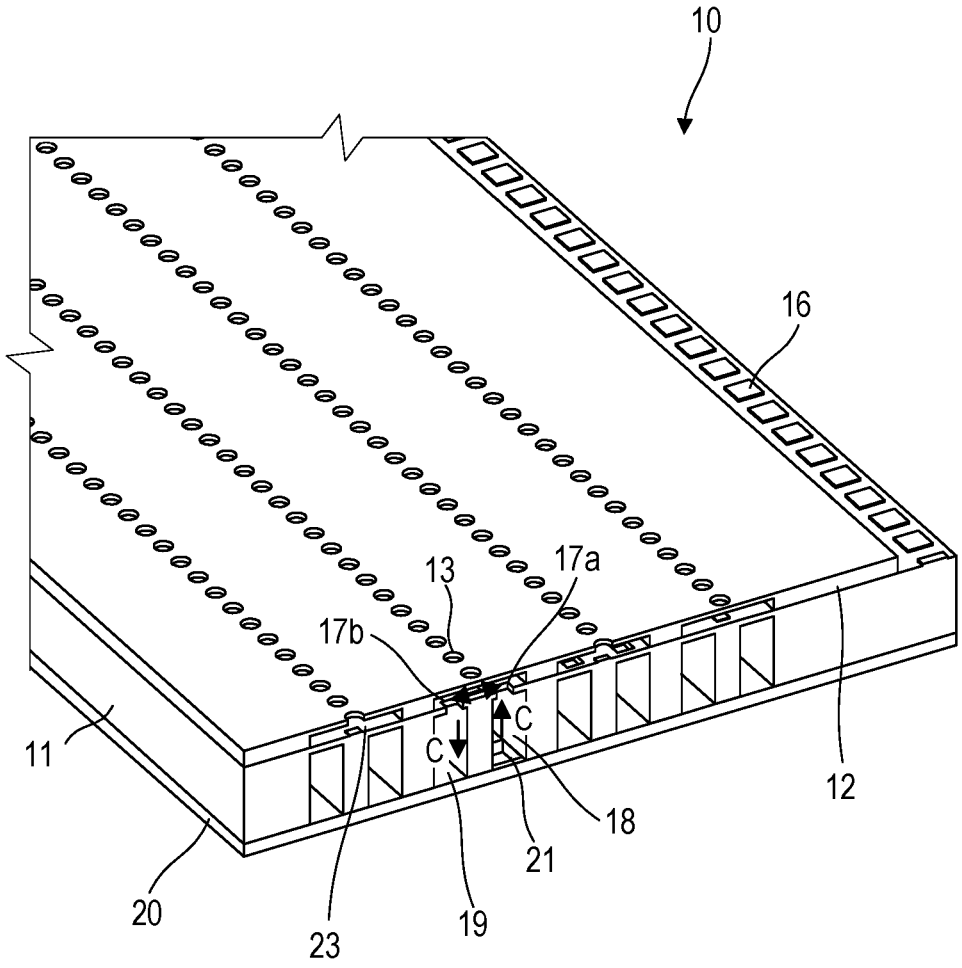
FIG. 10 is a partially cutout perspective view of the liquid ejection head illustrated in FIGS. 3A and 3B.

As illustrated in FIG. 9C and FIG. 10, a sheet-shaped lid member 20 is stacked on a back surface of the surface where the ejection ports 13 are formed, of the recording element substrate 10, and a plurality of openings 21 that communicate with the liquid supply path 18 and the liquid collection path 19 described later are provided in the lid member 20. In the present embodiment, the three openings 21 are provided for each liquid supply path 18, and the two openings 21 are provided for each liquid collection path 19 respectively in the lid member 20. As illustrated in FIG. 9B, the respective openings 21 in the lid member 20 communicate with the plurality of communication ports 51 illustrated in FIG. 5A. As illustrated in FIG. 10, the lid member 20 has a function as a lid that forms part of walls of the liquid supply paths 18 and the liquid collection paths 19 formed in the substrate 11 of the recording element substrate 10. The lid member 20 preferably is a member having sufficient corrosion resistance to the liquid, and from the viewpoint of prevention of color mixing, high precision is required of an opening shape and an opening position of the opening 21. Therefore, it is preferable to use a photosensitive resin material and a silicon as the material of the lid member 20, and provide the openings 21 by a photolithography process. In this way, the lid member converts pitches of the flow paths by the openings 21, is desirably thin in thickness considering a pressure loss, and is desirably formed of a film-shaped member.

Next, a flow of the liquid in the recording element substrate 10 will be described. FIG. 10 is a perspective view illustrating sections of the recording element substrate 10 and the lid member 20 in line 10-10 in FIG. 9A. The recording element substrate 10 has a structure in which the substrate 11 formed from Si and the ejection port formation member 12 formed from a photosensitive resin are stacked, and the lid member 20 is joined to a back surface of the substrate 11. The recording elements 15 are formed on one surface side of the substrate 11 (FIG. 9B), and on a back surface side of the substrate 11, grooves constructing the liquid supply paths 18 and the liquid collection paths 19 that run along the ejection port array are formed. The liquid supply path 18 and the liquid collection path 19 which are formed by the substrate 11 and the lid member 20 are respectively connected to the common supply flow path 211 and the common collection flow path 212 in the flow path member 210, and a differential pressure is generated between the liquid supply path 18 and the liquid collection path 19. When the liquid is ejected from the plurality of ejection ports 13 of the liquid ejection head 3, in the ejection port that does not perform an ejection operation, the liquid in the liquid supply path 18 provided in the substrate 11 flows to the liquid collection path 19 via the supply port 17*a*, the pressure chamber 23 and the collection port 17*b* by the aforementioned differential pressure. The flow is illustrated by arrows C in FIG. 10. By this flow, in the ejection port 13 that stops recording and the pressure chamber 23, ink with increased viscosity, bubbles, foreign matters and the like that are generated by evaporation from the ejection port 13 can be collected into the liquid collection path 19. Further, increase in viscosity of the ink in the ejection port 13 and the pressure chamber 23 can be suppressed. The liquid that is collected into the liquid collection path 19 is collected to the communication ports 51, the individual collection flow path 214 and the common collection flow path 212 in the flow path member 210 in this order through the openings 21 of the lid member 20 and the liquid communication ports 31 of the support member 30 (refer to FIG. 8B). Subsequently, the liquid is finally collected into the supply route of the recording apparatus 1000.

That is, the liquid which is supplied to the liquid ejection head 3 from the recording apparatus main unit flows in the following order, and is supplied and collected. The liquid flows to the inside of the liquid ejection head 3 from the liquid connection section 111 of the liquid supply unit 220 first. Subsequently, the liquid is supplied to the joint rubber 100, the communication ports 72 and the common flow channel 71 provided in the third flow path member, the common flow channel 62 and the communication ports 61 provided in the second flow path member, and the individual flow channel 52 and the communication ports 51 provided in the first flow path member in this order. Thereafter, the liquid is supplied to the pressure chamber 23 sequentially through the liquid communication ports 31 provided in the support member 30, the openings 21 provided in the lid member, and the liquid supply paths 18 and the supply ports 17*a* provided in the substrate 11. Of the liquids which are supplied to the pressure chambers 23, the liquid which is not ejected from the ejection port 13 flows sequentially in the collection ports 17*b* and the liquid collection path 19 which are provided in the substrate 11, the openings 21 provided in the lid member and the liquid communication ports 31 provided in the support member 30. Thereafter, the liquid sequentially flows in the communication ports 51 and the individual flow channels 52 which are provided in the first flow path member, the communication ports 61 and the common flow channels 62 which are provided in the second flow path member, the common flow channels 71 and the communication ports 72 which are provided in the third flow path member 70 and the joint rubbers 100. Subsequently, the liquid flows to outside of the liquid ejection head 3 from the liquid connection sections 111 provided in the liquid supply unit. In the mode of the first circulation route illustrated in FIG. 2, the liquid which flows in from the liquid connection section 111 is supplied to the joint rubber 100 after passing through the negative pressure control unit 230.

Further, as illustrated in FIG. 2, all of the liquid that flows in from one end of the common supply flow path 211 of the liquid ejection unit 300 is not supplied to the pressure chambers 23 via the individual supply flow paths 213*a*. Some parts of the liquid flow to the liquid supply unit 220 from the other end of the common supply flow path 211 without flowing into the individual supply flow paths 213*a*. In this way, by including the route through which the liquid flows without passing through the recording element substrates 10, a backflow of the circulation flow of the liquid can be suppressed, even in the case of having the recording element substrate 10 including flow paths which are very fine and having large flow path resistance as in the present embodiment. In this way, in the liquid ejection head of the present embodiment, increase in viscosity of the liquid in a vicinity of the pressure chamber and the ejection port can be suppressed, so that a deviation of the ejection direction and mis-ejection can be suppressed, as a result of which, recording with high image quality can be performed.

(Explanation of Positional Relation Among Recording Element Substrates)

Figure 11:
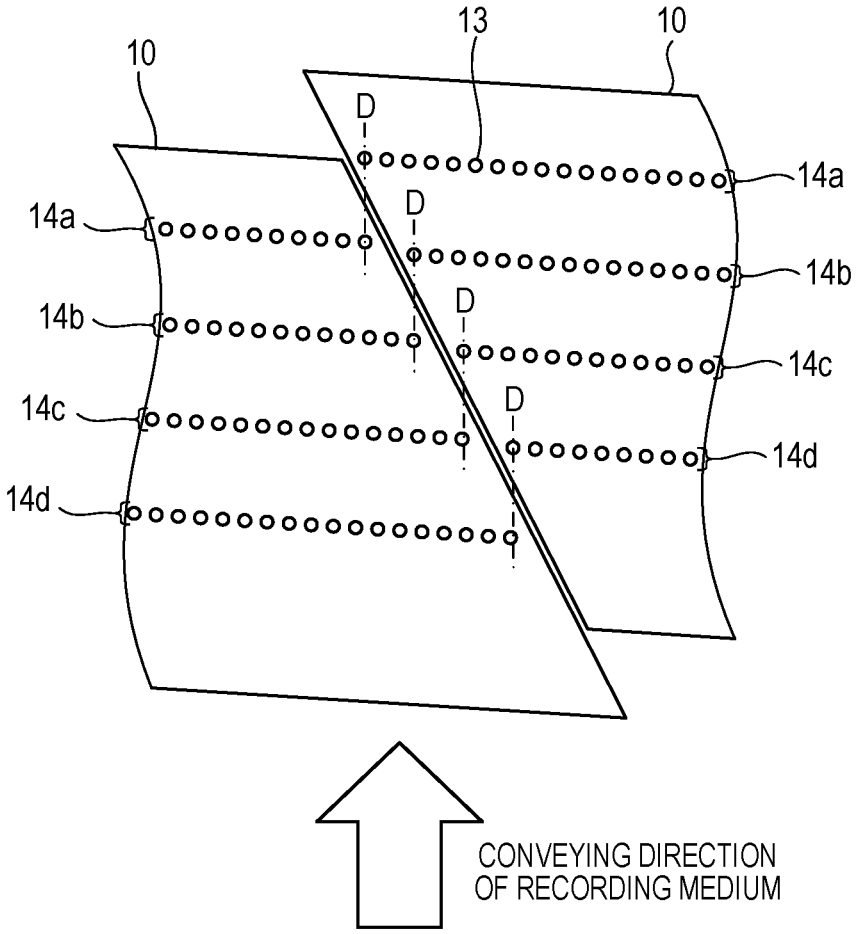
FIG. 11 is a main part enlarged plan view illustrating two adjacent recording element substrates of the liquid ejection head illustrated in FIGS. 3A and 3B.

FIG. 11 is a plan view illustrating an adjacent portion of the recording element substrates in the two adjacent ejection modules by partially enlarging the adjacent portion. As illustrated in FIGS. 9A to 9C, in the present embodiment, the recording element substrate in a substantially parallelogram is used. As illustrated in FIG. 11, respective election port arrays 14*a* to 14*d* in which the ejection ports 13 are arranged in the respective recording element substrates 10 are disposed so as to incline at fixed angles to a conveying direction (moving direction) of the recording medium. Thereby, in the ejection port arrays in the adjacent portion of the recording element substrates 10, at least one ejection port overlaps in the conveying direction of the recording medium. In FIG. 11, two ejection ports on line D are in an overlapping relation with each other. By disposition like this, even when the position of the recording element substrate 10 deviates from a predetermined position to some degrees, a black streak and a white patch in the recorded image can be made less noticeable by drive control of the ejection ports which overlap each other. When a plurality of recording element substrates 10 are disposed rectilinearly (in line) instead of being arranged in a staggered fashion, a black streak and a white patch in the connecting portion of the recording element substrates 10 can be suppressed while increase in the length in the conveying direction of the recording medium, of the liquid ejection head 3 is suppressed by the structure in FIG. 11. Note that in the present embodiment, a main plane of the recording element substrate is in a parallelogram, but the present disclosure is not limited to this, and even when the recording element substrates in a rectangle, a trapezoid and other shapes are used, the structure of the present disclosure can be preferably applied.

Figure 12A:
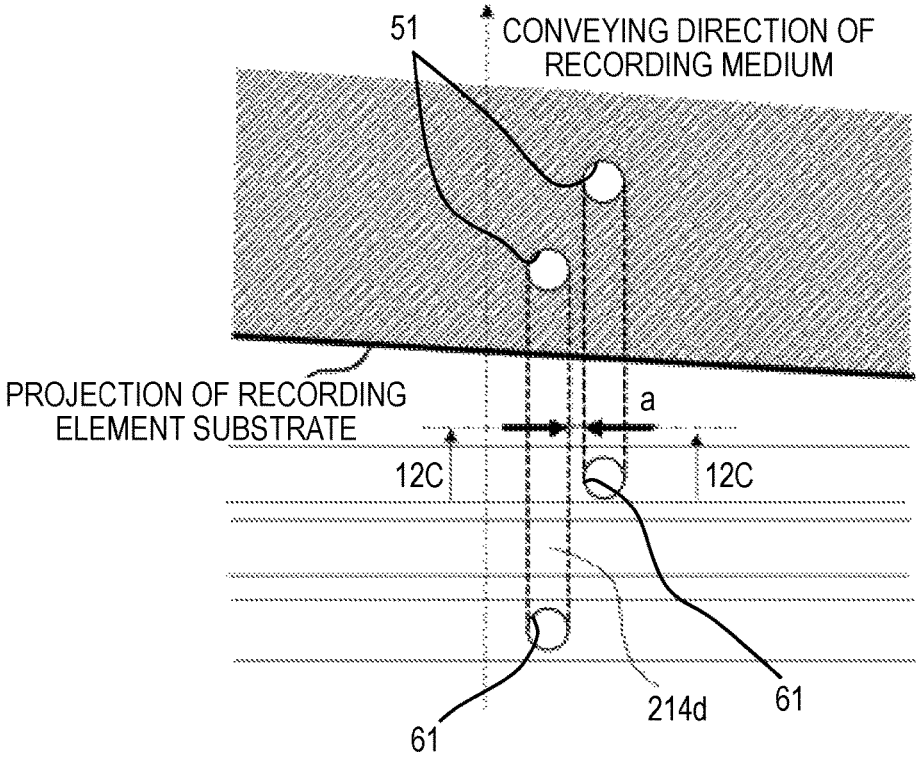
FIGS. 12A, 12B, 12C and 12D are explanatory views explaining an effect of the present disclosure in comparison with a conventional construction.
Figure 12C:
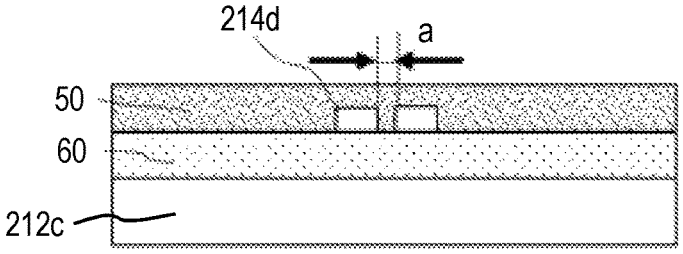
Figure 12B:
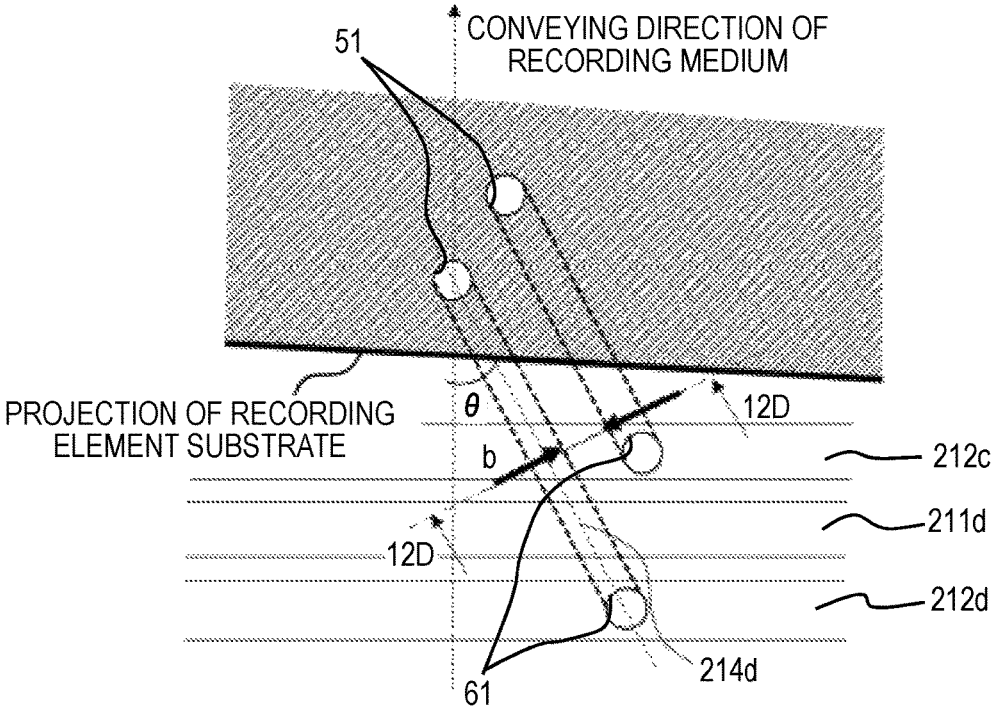
Figure 12D:
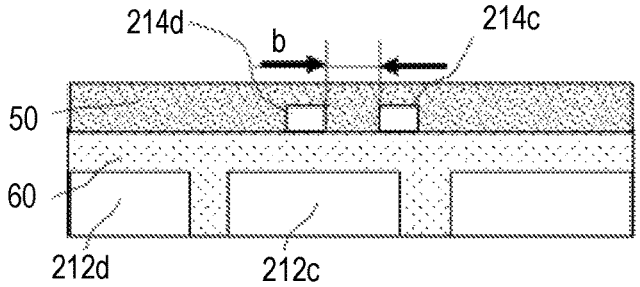

As described above, in the present embodiment, the communication ports 51 of the first flow path member 50 are arranged in a staggered fashion correspondingly to the openings 21 for the respective liquids of the recording element substrate 10. The respective openings 21 and the respective communication ports 51 are connected by the individual flow paths 213 and 214. These individual flow paths 213 and 214 run in a direction that obliquely intersects the conveying direction of the recording medium. In detail, as seen from the ejection port array surface 10*a* of the recording element substrate 10, the individual flow paths 213 and 214 run in a direction that extends obliquely to the conveying direction (the moving direction) of the recording medium from portions connected to the liquid supply path 18. Thereby, as compared with a case where the individual flow paths 213 and 214 run parallel with the conveying direction of the recording medium, a width of a seal region between the individual flow paths 213 and 214 can be ensured to be wide. As a result, the individual flow paths can be formed independently, and it is possible to form the flow paths in which the liquid flowing in the adjacent flow paths does not flow, and mixing of liquids of different kinds (different colors) is suppressed. Concerning the width of the seal region between the individual flow paths, comparison of the conventional structure and the present embodiment is illustrated in FIGS. 12A to 12D. FIG. 12A is a plan view illustrating the conventional structure in which the individual flow paths 213 and 214 run substantially parallel to the conveying direction of the recording medium, and FIG. 12C is a sectional view taken along line 12C-12C in FIG. 12A. For convenience, the same reference signs as in the present disclosure are assigned. In the case of this structure, a space between the adjacent individual flow paths, that is, a joint margin of the first flow path member 50 is "a". FIG. 12B is a plan view illustrating a structure of the present embodiment in which the individual flow paths 213 and 214 run obliquely by an angle θ ($0°<\theta<90°$) to the conveying direction of the recording medium, and is a view of a 12B portion in FIG. 6 by enlarging the 12B portion. FIG. 12D is a sectional view taken along line 12D-12D in FIG. 12B. In the case of the structure, a space between the adjacent individual flow paths, that is, a joint margin of the first flow path member is "b". As is obvious from FIGS. 12A to 12D, the joint margin "b" of the present embodiment can be ensured to be larger than the joint margin "a" of the conventional configuration, so that reliability of sealing of the respective flow paths is high, and possibility of a trouble such as mixing of liquids (color mixing) and a leakage can be reduced.

Figure 13:
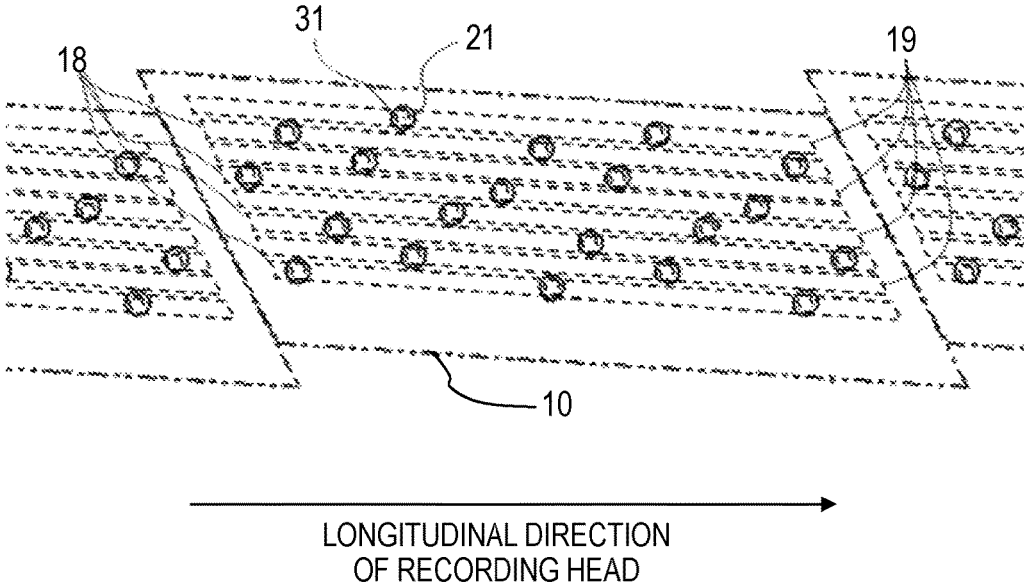
FIG. 13 is a plan view illustrating an example of a positional relation of the communication ports of the support member, and the liquid supply paths and the liquid collection paths of the recording element substrate of the present disclosure.

Another effect of the present embodiment in which the individual flow paths 213 and 214 run in the direction to intersect the conveying direction of the recording medium obliquely will be described as follows. FIG. 13 is a view illustrating a positional relation of the liquid communication ports 31 of the support member 30, the liquid supply paths 18 and the liquid collection paths 19 of the recording element substrate 10. The liquid communication ports 31 are formed in positions that allow the liquid communication ports 31 to communicate with the communication ports 51 of the first flow path member 50. The liquid which is supplied from the liquid communication port 31 is supplied to the liquid supply path 18 through the opening 21 formed in the lid member 20 of the recording element substrate 10, and a part of the liquid which is not ejected flows into the liquid collection path 19. Further, the liquid which flows into the liquid collection path 19 reaches the individual collection flow path via the opening 21, the liquid communication port 31 and the communication port 51. Here, the liquid flows into the liquid supply path 18 with the openings 21 as inlets for liquid inflow, and the liquid flowing in is supplied to the respective ejection ports while flowing in the ejection port array direction. At this time, the liquid absorbs heat from the recording element substrate 10 while flowing, so that a temperature of the liquid gradually increases. As a result, a temperature distribution of the liquid occurs along the ejection port array direction, and unevenness of the ejection amount is likely to be caused in accordance with the temperature characteristics of the liquid. Therefore, it is preferable to determine the positions where the openings 21 are disposed, with the temperature distribution and the like taken into consideration. For example, in order to reduce density unevenness in the joint portion of the recording element substrates 10, it is effective to shorten the distance in which the liquid flows to the end portion, and reduce the temperature increase of the liquid by disposing the openings 21 of the liquid supply paths 18 at the end portions of the recording element substrate 10. If the individual flow paths are disposed obliquely as in the present embodiment, even when the liquid supply path and the liquid collection path are provided adjacently at a narrow pitch, the joint margin between the individual flow paths can be ensured while the openings 21 are disposed concentratedly at the end portions of the recording element substrate 10. Thereby, unevenness in the joint portion between the adjacent recording element substrates can be reduced.

Figure 14:
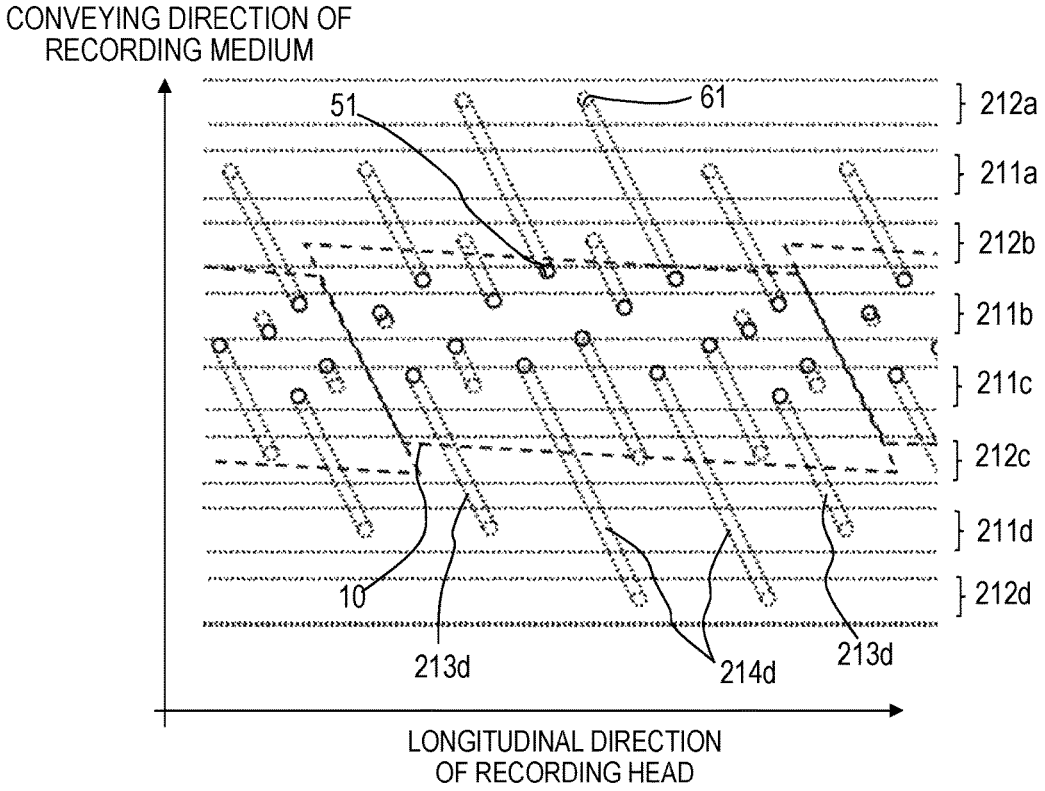
FIG. 14 is a transparent view of a flow path member of a liquid ejection head of a modified example of the first embodiment of the present disclosure.
Figure 15:
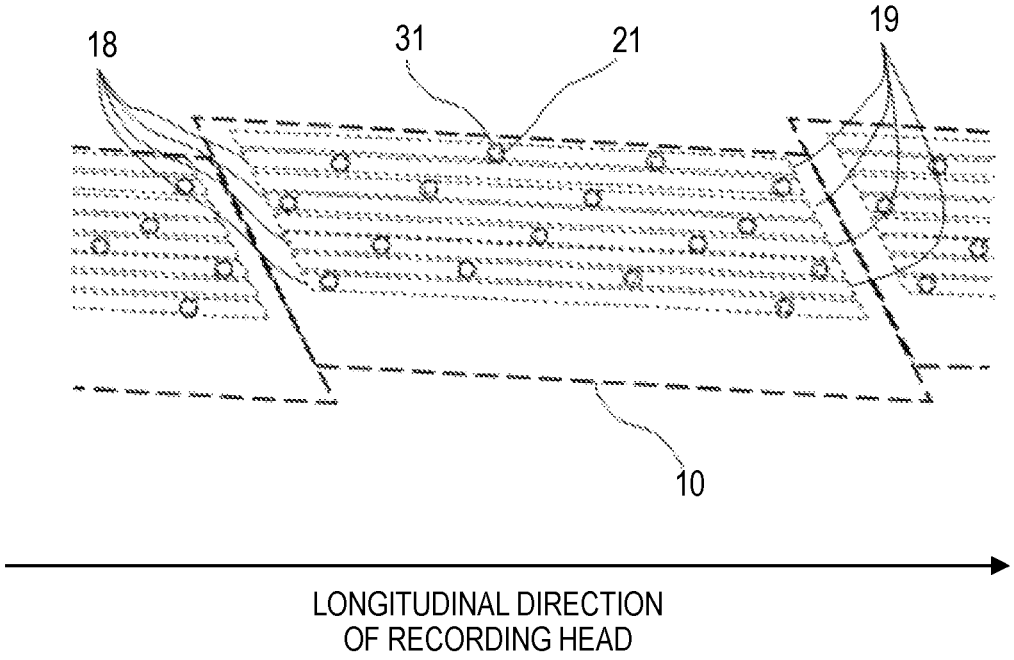
FIG. 15 is a plan view illustrating a positional relation of the communication ports of the support member, and the liquid supply paths and the liquid collection paths of the recording element substrate of the modified example of the first embodiment of the present disclosure.

In the present embodiment, the example is shown in which the three openings 21 are provided in the liquid supply path 18 and the two openings 21 are provided in the liquid collection path 19, but the present invention is not limited to this. For example, as illustrated in FIGS. 14 and 15, a structure in which the two openings 21 are provided in each of the liquid supply paths 18, and the two openings 21 are provided in each of the liquid collection paths 19 may be adopted. Though not illustrated in FIG. 15, the communication port 51 is provided in a position projected to overlap the opening 21, and the opening 21 communicates with the communication port 51. At this time, it is preferable that the individual supply flow paths 213 of the respective liquids are located outside from the individual collection flow paths 214 in which the same liquids flow, because the effect of suppressing unevenness is large.

Second Embodiment

A second embodiment of the present disclosure will be described hereinafter.

Figure 16:
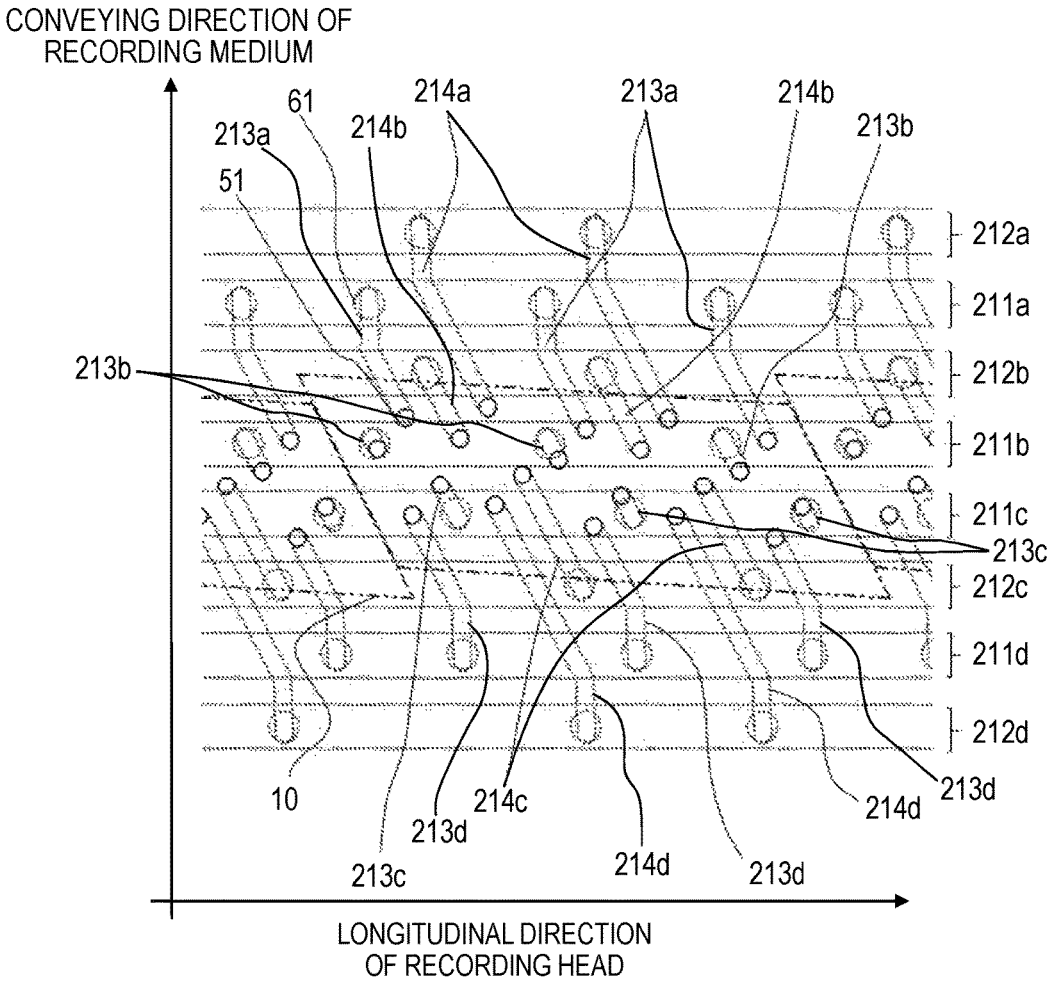
FIG. 16 is a transparent view of a flow path member of a liquid ejection head of a second embodiment of the present disclosure.

FIG. 16 is an enlarged transparent view of some of flow paths in the flow path member 210 formed by joining the first to third flow path members in the second embodiment, seen from a side of a surface on which the ejection module 200 of the first flow path member 50 is mounted. The individual flow paths 213 and 214 which are formed in the first flow path member 50 are formed obliquely to the conveying direction of the recording medium at a communication port 51 side, but are formed parallel to the conveying direction of the recording medium at a communication port 61 side. When the distance of the adjacent individual flow paths 213 and 214 is such that the distances of the communication ports 61 can be sufficiently ensured as compared with the communication port 51 side, the communication port 61 sides of the respective individual flow paths do not have to be formed obliquely to the conveying direction of the recording medium, but may be formed parallel as illustrated in FIG. 16. The structure of the first embodiment and the structure of the second embodiment can be favorably selected in accordance with the positions where the communication ports 61 are disposed.

In this way, in the present disclosure, the individual flow paths 213 and 214 run in the direction extending obliquely to the moving direction of the recording medium, at least in a range overlapping the recording element substrate 10 from the portion connected to the liquid supply path 18 or the liquid collection path 19 as seen from the ejection port array surface. However, the individual flow paths 213 and 214 may run parallel to the moving direction of the recording medium in a position that does not overlap the recording element substrate 10, as seen from the ejection port array surface 10*a*.

Third Embodiment

A third embodiment of the present disclosure will be described hereinafter.

Figure 17A:
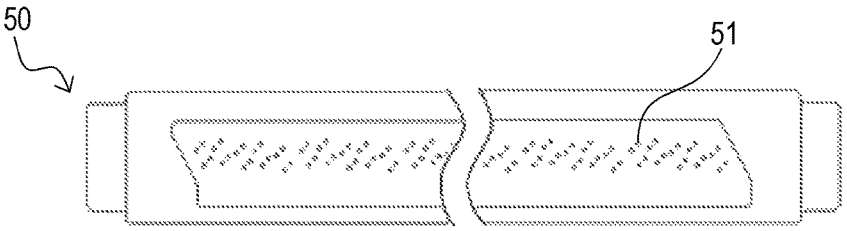
FIGS. 17A, 17B, 17C, 17D, 17E and 17F are plan views and bottom views of respective flow path members of a liquid ejection head of a third embodiment of the present disclosure.
Figure 17B:
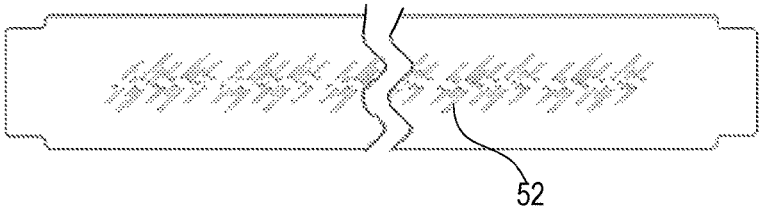
Figure 17C:
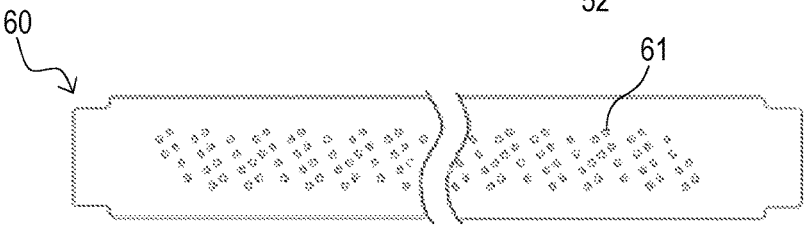
Figure 17D:
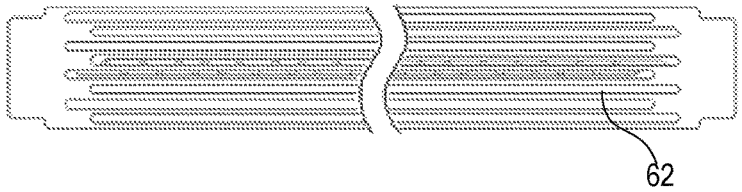
Figure 17E:
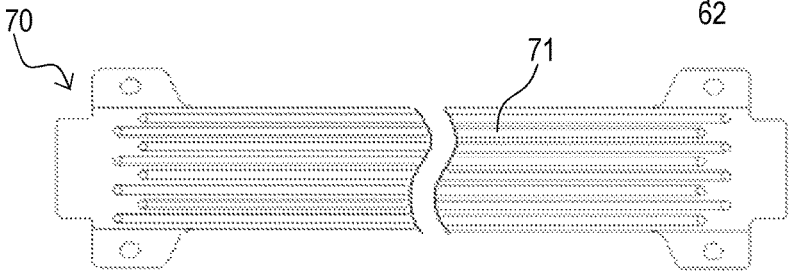
Figure 17F:
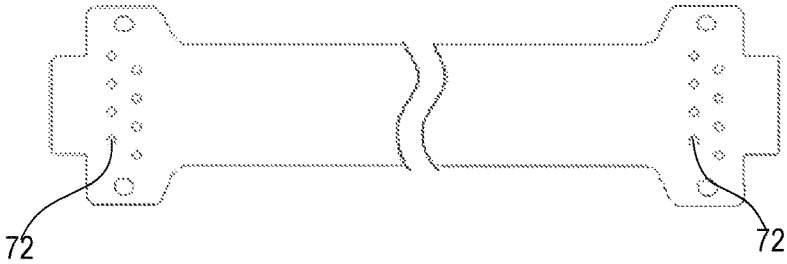
Figure 18:
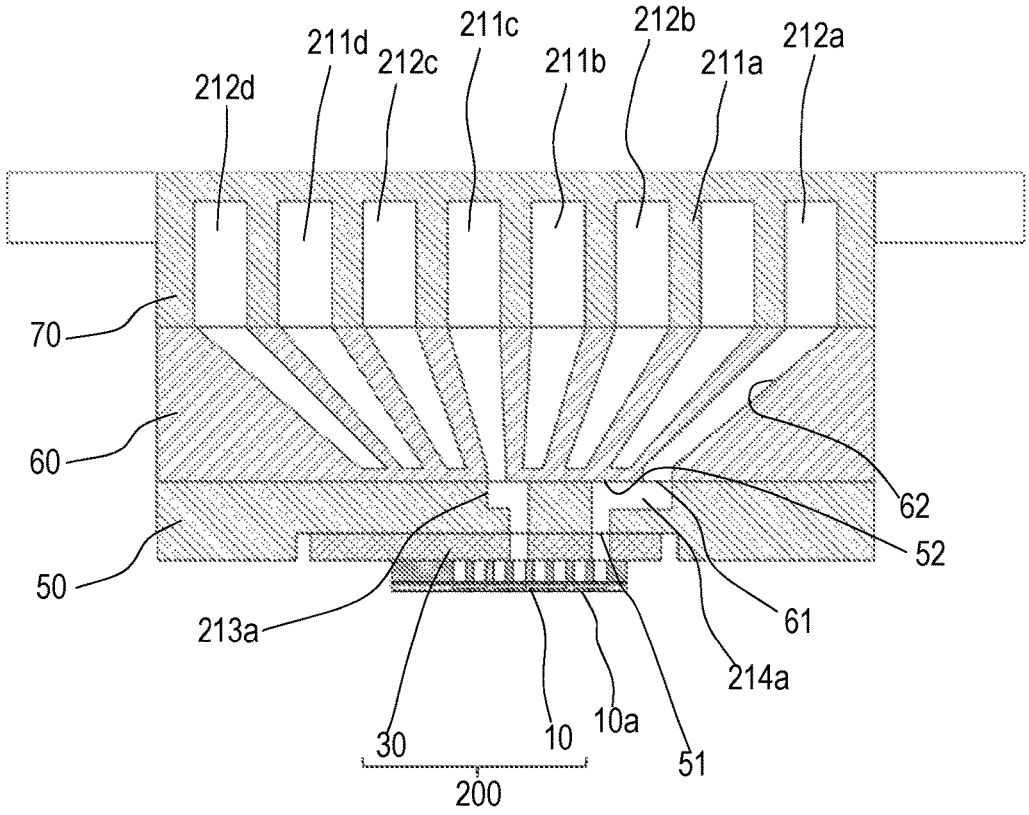
FIG. 18 is a sectional view of the liquid ejection head of the third embodiment of the present disclosure.

FIGS. 17A to 17F are views illustrating front surfaces and back surfaces of the first to third flow path members in the present embodiment. FIG. 17A illustrates a front surface of the first flow path member, and FIG. 17B illustrates a back surface of the first flow path member. FIG. 17C illustrates a front surface of the second flow path member, and FIG. 17D illustrates a back surface of the second flow path member. FIG. 17E illustrates a front surface of the third flow path member, and FIG. 17F illustrates a back surface of the third flow path member. In the present embodiment, the flow paths provided in the second flow path member 60 are formed into a taper shape toward a front surface side illustrated in FIG. 17C from a back surface side illustrated in FIG. 17D. FIG. 18 which is a sectional view illustrates the flow paths in the taper shape of the second flow path member 60. The flow paths of the second flow path member 60 are formed into the taper shape in this way, so that the pitch of the flow paths at the first flow path member 50 side can be formed to be narrow with respect to the pitch of the flow paths at the third flow path member 70 side, and the individual flow paths of the first flow path member can be shortened. The length of the individual flow channel 52 being short means that the possibility of a trouble such as mixing of liquids (color mixing) and a leakage can be reduced in the individual flow path. In other words, the seal region between the individual flow paths has a higher reliability in sealing and a probability of occurrence of poor sealing is reduced, as a dimension in the width direction of the flow path is larger and a dimension in the longitudinal direction of the flow path is smaller. In the present embodiment, the common flow channels 62 in the taper shape is provided in the second flow path member which is a single member, and the communication ports 61 are formed in the front surface. However, the second flow path member of a multilayer structure may be formed by joining a plate member in which only the common flow channels 62 are formed, and a member on which the shapes of the communication ports 61 are formed.

Fourth Embodiment

A fourth embodiment of the present disclosure will be described hereinafter with use of FIGS. 19 and 20.

Figure 19:
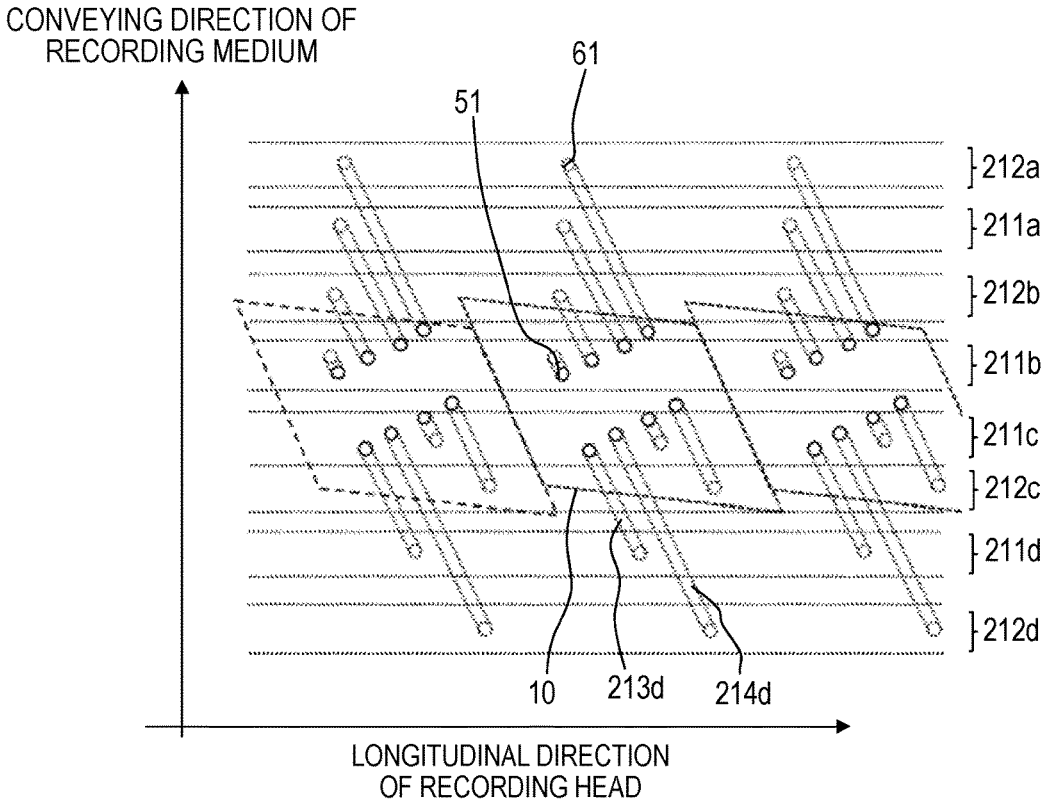
FIG. 19 is a transparent view of a flow path member of a liquid ejection head of a fourth embodiment of the present disclosure.
Figure 20:
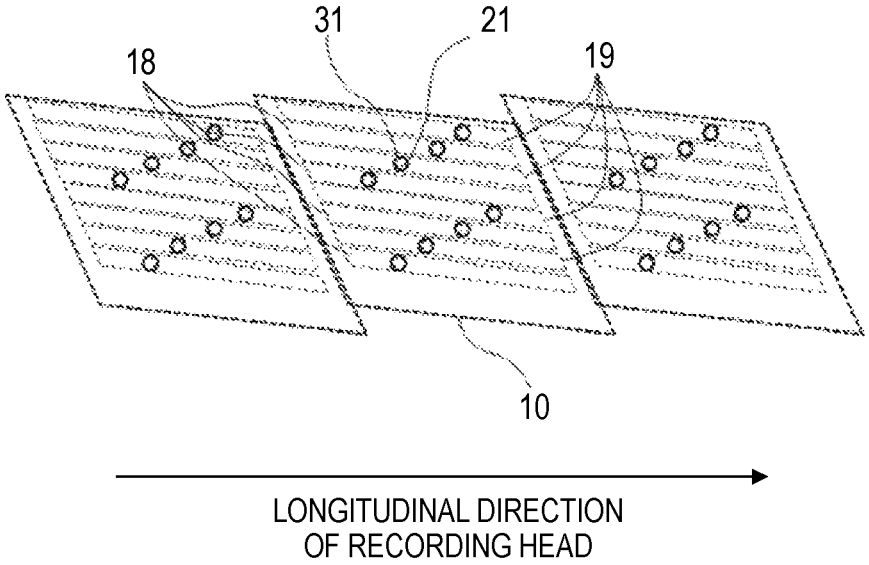
FIG. 20 is a plan view of a positional relation of communication ports of a support member, and liquid supply paths and liquid collection paths of a recording element substrate of the fourth embodiment of the present disclosure.

FIG. 19 is an enlarged transparent view of part of flow paths in the flow path member 210 that is formed by joining the first to third flow path members in the present embodiment, as seen from a side of a surface on which an ejection module is mounted. FIG. 20 is a view illustrating a positional relation of the liquid communication ports 31 of the support member 30, and the liquid supply paths 18 and the liquid collection paths 19 of the recording element substrate 10. Though not illustrated in FIG. 20, the communication ports 51 are provided in positions projected to overlap the openings 21, and the openings 21 and the communication ports 51 communicate with each other. In the present embodiment, for a pair of the liquid supply path 18 and the liquid collection path 19 of the recording element substrate 10, only one individual flow path (213 or 214) that communicates with the liquid supply path 18 and the liquid collection path 19 is formed. The number of individual supply flow paths 213 which are connected to a pair of the common supply flow path 211 and the common collection flow path 212 is preferably the number of individual collection flow paths 214 which are connected to the common supply flow path 211 and the common collection flow path 212 of the pair, or more.

When the length of the recording element substrate 10 in the longitudinal direction of the liquid ejection head is not so long, and the length of the liquid supply path 18 from the opening 21 is short, density unevenness in the connecting portion of the recording element substrates due to a temperature increase of the liquid does not matter so much. In such a case, to one of the liquid supply paths 18 and one of the liquid collection paths 19 of the recording element substrate 10, only one individual flow path (213 or 214) communicating with the liquid supply path 18 and the liquid collection path 19 may be formed as described above. Note that in the present embodiment, sealing between the individual flow paths 213 and 214 can be reliably performed by forming the individual flow paths 213 and 214 to run in the direction extending obliquely to the conveying direction of the recording medium.

In the aforementioned embodiment, the liquid circulation path including the common supply flow path 211, the individual supply flow path 213, the liquid supply path 18, the liquid collection path 19, the individual collection flow path 214 and the common collection flow path 212 is formed. The individual flow paths 213 and 214 run in the direction extending obliquely to the moving direction of the recording medium from the portion connected to the liquid supply path 18 or the liquid collection path 19, as seen from the ejection port array surface 10*a*. The portions where the individual supply flow paths 213 and 214 run in the direction extending obliquely to the moving direction of the recording medium from the portion connected to the liquid supply path 18 or the liquid collection path 19 are parallel with each other. However, the present invention is not limited to this structure. When the liquid circulation path is not formed, a plurality of individual supply flow paths 213 run in the direction extending obliquely to the moving direction of the recording medium from the portion connected to the liquid supply path 18. The portions running in the direction extending obliquely to the moving direction of the recording medium, of the plurality of individual supply flow paths 213 are parallel with one another.

The recording element substrate 10 may have an elongate plane shape extending in the direction (for example, the orthogonal direction) intersecting the moving direction of the recording medium. An angle at which the longitudinal direction of the recording element substrate 10 intersects the moving direction of the recording medium, and the angle at which the individual flow paths 213 and 214 run obliquely to the moving direction of the recording medium from the portion connected to the liquid supply path 18 or the liquid collection path 19 preferably correspond to each other.

According to the liquid ejection head of the present disclosure, even when the number of flow paths for supplying the liquid to the recording element substrates is large, reliability of sealing between the adjacent flow paths is high, and liquid ejection with high quality can be performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-133996, filed Jul. 7, 2017, which is hereby incorporated by reference herein in its entirety.

What is claimed is:

1. A liquid ejection head of a page-wide type, comprising:

a plurality of recording element substrates each having an ejection port array including a plurality of ejection ports for ejecting a liquid, each ejection port communicating with a pressure chamber including therein a recording element that generates energy for ejecting a liquid, and a liquid supply path that supplies a liquid to the pressure chamber; and a flow path member on which the plurality of recording element substrates are arranged, wherein the flow path member includes a plurality of common supply flow paths that are provided adjacently to each other as running along a longitudinal direction of the liquid ejection head for supplying a liquid to the plurality of recording element substrates, and a plurality of individual supply flow paths that connect the liquid supply path of each recording element substrate to the common supply flow paths, and the plurality of individual supply flow paths include portions running obliquely to a direction orthogonal to the longitudinal direction of the liquid ejection head, as viewed from an ejection port array surface having the ejection port array.

2. The liquid ejection head according to claim 1, wherein a support member is provided between the flow path member and the recording element substrates, and the support member has a flow path that connects the liquid supply path to the individual supply flow paths, and the individual supply flow paths run in a direction extending obliquely to the orthogonal direction, from a communication port that is connected to the flow path of the support member, as viewed from the ejection port array surface.

3. The liquid ejection head according to claim 1, wherein the plurality of individual supply flow paths run along one another in a direction extending obliquely to the orthogonal direction, from a portion connected to the liquid supply path, as viewed from the ejection port array surface.

4. The liquid ejection head according to claim 1, wherein the individual supply flow paths run in a direction extending obliquely to the orthogonal direction, at least in a range overlapping the recording element substrates, from a portion connected to the liquid supply path, as viewed from the ejection port array surface.

5. The liquid ejection head according to claim 4, wherein the individual supply flow paths have a portion running along the orthogonal direction, in a position that does not overlap the recording element substrates, as viewed from the ejection port array surface.

6. The liquid ejection head according to claim 1, wherein the recording element substrates have a plurality of liquid supply paths, each of the liquid supply paths has an opening for liquid inflow, and the plurality of openings are arranged in a staggered fashion.

7. The liquid ejection head according to claim 1, further comprising:

a liquid collection path that is formed and connected to the ejection ports and the liquid supply path in each recording element substrate;

a plurality of common collection flow paths for collecting a liquid from the liquid collection path of each recording element substrate; and a plurality of individual collection flow paths that connect the liquid collection path of each recording element substrate to the common collection flow paths, wherein a liquid circulation path including the common supply flow paths, the individual supply flow paths, the liquid supply path, the liquid collection path, the individual collection flow paths and the common collection flow paths is formed.

8. The liquid ejection head according to claim 7, wherein the number of individual supply flow paths connected to a single pair of common supply flow path and common collection flow path is not less than the number of individual collection flow paths connected to the same pair of common supply flow path and common collection flow path.

9. The liquid ejection head according to claim 7, wherein the individual collection flow paths have a portion running obliquely to the orthogonal direction, from a portion connected to the liquid collection path, as viewed from the ejection port array surface.

10. The liquid ejection head according to claim 9, wherein a portion where the individual supply flow paths run in a direction extending obliquely to the orthogonal direction from a portion connected to the liquid supply path, and a portion where the individual collection flow paths run in a direction extending obliquely to the orthogonal direction from the portion connected to the liquid collection path run along each other.

11. The liquid ejection head according to claim 1, wherein the recording element substrates have an elongate plane shape extending in a direction intersecting the orthogonal direction, and an angle at which a widthwise direction of the recording element substrates intersects the orthogonal direction, and an angle at which the individual supply flow paths run obliquely to the orthogonal direction from a portion connected to the liquid supply path correspond to each other.

12. The liquid ejection head according to claim 1, wherein in the flow path member, a plurality of plate members are stacked.

13. The liquid ejection head according to claim 1, wherein each individual supply flow path is formed by a groove formed on a surface at a side opposite to a recording element substrate side of a plate member, and a hole that communicates with the groove and opens to a surface at the recording element substrate side of the plate member.

14. The liquid ejection head according to claim 1, wherein the plurality of recording element substrates are rectilinearly disposed along the longitudinal direction of the liquid ejection head.

15. The liquid ejection head according to claim 1, wherein a liquid inside each of the pressure chambers is circulated between inside and outside of the pressure chamber.

16. A liquid ejection head of a page-wide type, comprising:

a plurality of recording element substrates each including a plurality of ejection ports for ejecting a liquid, each ejection port communicating with a pressure chamber including therein a recording element generating energy for ejecting a liquid; and a flow path member on which the plurality of recording element substrates are arranged, wherein the flow path member includes first and second common flow paths that are provided adjacently to each other as running along a longitudinal direction of the liquid ejection head and communicate with the plurality of recording element substrates, and first and second individual supply flow paths that cause the first and second common flow paths and the recording element substrates to communicate with one another, and the first and second individual supply flow paths include portions running along each other obliquely to a direction orthogonal to the longitudinal direction of the liquid ejection head, as viewed from a surface where the ejection ports are provided.

17. The liquid ejection head according to claim 16, wherein at least one of the first and second common flow paths is a common flow path for collecting a liquid from the recording element substrates.

18. The liquid ejection head according to claim 16, wherein the plurality of recording element substrates are disposed rectilinearly along the longitudinal direction of the liquid ejection head.

19. The liquid ejection head according to claim 16, wherein a liquid inside each of the pressure chambers is circulated between inside and outside the pressure chamber.

* * * * *